US009205672B1

(12) United States Patent
Bitoh

(10) Patent No.: US 9,205,672 B1
(45) Date of Patent: Dec. 8, 2015

(54) DRAWING APPARATUS WITH A DRAWING HEAD AND A DRAWING TOOL AND CONTROL METHOD

(71) Applicant: CASIO COMPUTER CO., LTD., Shibuya-ku, Tokyo (JP)

(72) Inventor: Hiroyasu Bitoh, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/476,327

(22) Filed: Sep. 3, 2014

(51) Int. Cl.
*B41J 29/393* (2006.01)
*B41J 3/407* (2006.01)

(52) U.S. Cl.
CPC ..... *B41J 3/407* (2013.01); *B41J 3/4073* (2013.01)

(58) Field of Classification Search
CPC ..... B41J 3/407; B41J 3/4073; B41J 3/54; B41J 3/60; B41J 3/543; B41J 3/546; B41J 11/008; A45D 29/00; A45D 2029/005
See application file for complete search history.

(56) References Cited

U.S. PATENT DOCUMENTS 5,371,531 A * 12/1994 Rezanka et al. ..... 347/43
6,286,517 B1 9/2001 Weber et al.

FOREIGN PATENT DOCUMENTS

JP 2003534083 A 11/2003

* cited by examiner

*Primary Examiner* — Juanita D Jackson
(74) *Attorney, Agent, or Firm* — Holtz, Holtz, Goodman & Chick PC

(57) ABSTRACT

A drawing apparatus includes a drawing unit which is provided with at least one drawing head ejecting a first ink to perform drawing on a drawing target and at least one drawing tool in contact with the drawing target to perform drawing on the drawing target with a second ink; and a control unit controlling the drawing unit to perform first drawing on the drawing target with one of the drawing head and the drawing tool and perform second drawing with the other of the drawing head and the drawing tool over a region of the first drawing on the drawing target. This configuration achieves a variety of images drawn on the drawing target with a combination of the drawing head and the drawing tool.

20 Claims, 15 Drawing Sheets

DRAWING APPARATUS WITH A DRAWING HEAD AND A DRAWING TOOL AND CONTROL METHOD

BACKGROUND OF THE INVENTION

1. Field of the Invention

The present invention relates to a drawing apparatus and a control method for the drawing apparatus.

2. Description of the Related Art

A typical known nail printing apparatus includes an ink jet print head and prints a design image including color or a picture on the surface of the nail of a human finger. One of such nail printing apparatuses is disclosed, for example, in Japanese Unexamined Patent Application Publication No. 2003-534083.

The inkjet print head ejects ink droplets from a nozzle provided on a plane facing a print target, causes ink droplets to impact on the print target, and fixes the ink droplets to print an image on the print target.

Unfortunately, the ink jet print head has nozzles with a comparatively small hole diameter for ejecting ink droplets and thus causes frequent clogging of the nozzles due to precipitation of color material. The ink jet print head can therefore use only inks containing color materials having a comparatively small particle diameter.

As a result, in order to print an image including, for example, gold, silver, and white, the ink jet print head should use gold, silver, or white inks having comparatively small particle diameters. Unfortunately, such inks cannot appropriately develop intended colors. The ink jet print head cannot achieve print of beautiful white nor glittering nail designs. This limits printable nail designs.

Additionally, inks used in the inkjet system are usually permeable. When such inks are applied on a white background, such as paper, they can develop their original colors. As a result, printing with the ink jet system requires a white undercoat applied on the print target in order to sufficiently develop the color of the ink.

Unfortunately, the ink jet print head cannot use inks containing color materials, such as a white color material, having a comparatively large particle diameter as described above. A user therefore should apply a white undercoat by him/herself.

This operation takes labor and causes, for example, undrawn portions, protruding inks, uneven color printing due to an uneven white undercoat layer, leading to unsatisfactory finishing.

BRIEF SUMMARY OF THE INVENTION

The present invention can advantageously provide a drawing apparatus having a simple configuration that can make a variety of sophisticated nail prints comparable with those applied in nailariums and a control method for the drawing apparatus.

According to an aspect of the present invention, there is provided a drawing apparatus including:

a drawing unit which is provided with at least one drawing head ejecting a first ink to perform drawing on a drawing target and at least one drawing tool in contact with the drawing target to perform drawing on the drawing target with a second ink; and a control unit controlling the drawing unit to perform first drawing on the drawing target with one of the drawing head and the drawing tool and perform second drawing with the other of the drawing head and the drawing tool over a region of the first drawing on the drawing target.

According to another aspect of the present invention, there is provided a control method for a drawing apparatus including:

performing first drawing on a drawing target with one of at least one drawing head ejecting a first ink to perform drawing on a drawing target and at least one drawing tool in contact with the drawing target to perform drawing on the drawing target with a second ink; and performing second drawing with the other of the at least one drawing head and the at least one drawing tool over a region of the first drawing on the drawing target.

BRIEF DESCRIPTION OF THE SEVERAL VIEWS OF THE DRAWING

FIG. 5A is a side view of the penholder and the pen; and FIG. 5B is a top view of the penholder and the pen viewed along an arrow b in FIG. 5A while FIG. 5C is a front view thereof viewed along an arrow c in FIG. 5A.

FIG. 6A is a side view of the penholder and the pen; and FIG. 6B is a top view of the penholder and the pen viewed along an arrow b in FIG. 6A while FIG. 6C is a front view thereof viewed along an arrow c in FIG. 6A.

FIGS. 9A to 9D2 are plane views illustrating exemplary images drawn on nails with the drawing apparatus in the first embodiment.

DETAILED DESCRIPTION OF THE INVENTION

Figure 1:
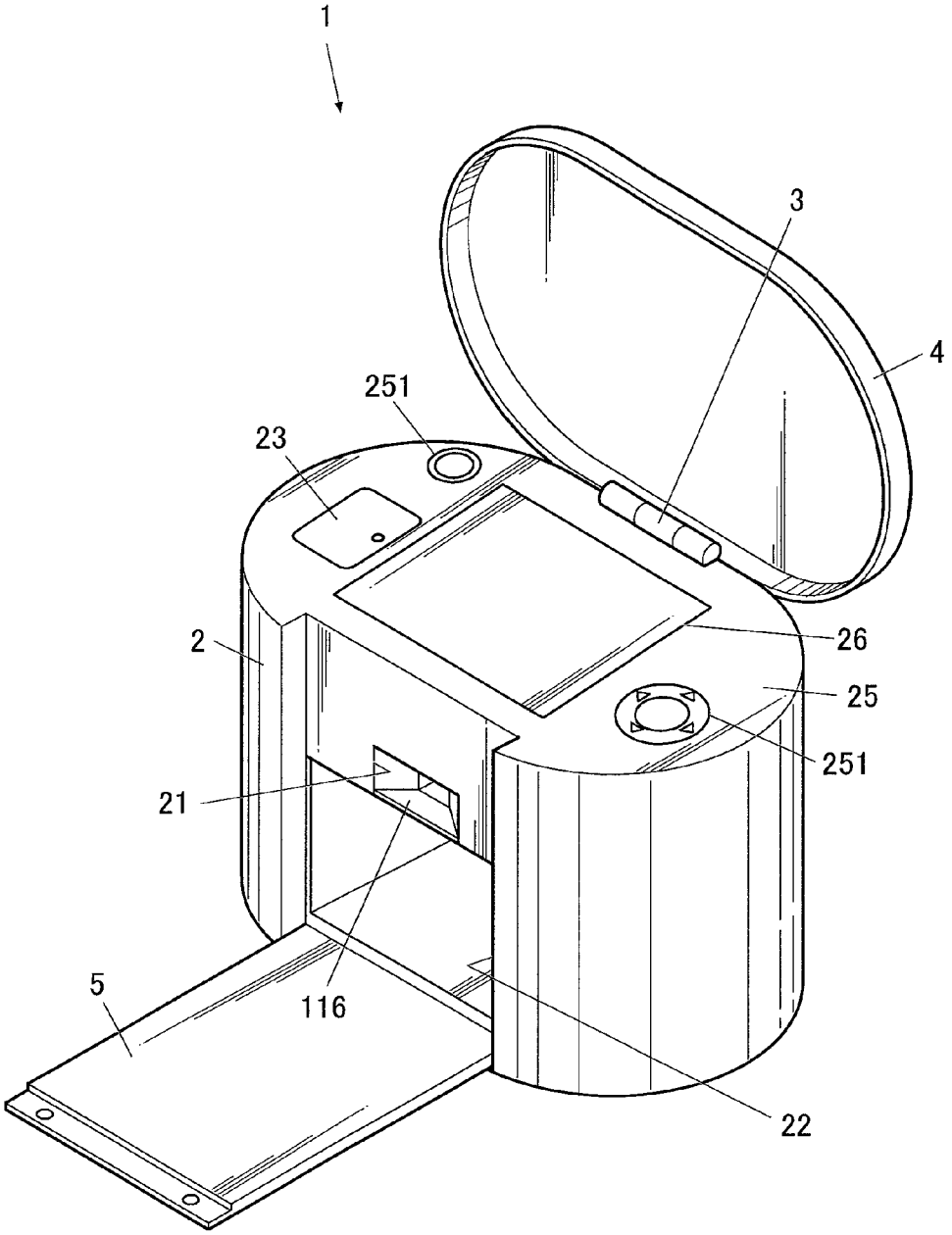
FIG. 1 is a perspective outline view illustrating a drawing apparatus and an opened lid in a first embodiment.

Embodiments of a drawing apparatus according to the present invention will now be described with reference to the attached drawings.

The embodiments described below include various technical limitations to implement the present invention. However, the scope of the invention is not limited to the embodiments and the illustrated examples described below.

In the following embodiments, the drawing apparatus is described by a nail printing apparatus that draws images on nails of fingers as a drawing target.

In the present invention, however, the drawing target for drawing should not be limited to nails of fingers. For example, the drawing target for drawing may be nails of toes.

First Embodiment

A first embodiment of the drawing apparatus according to the present invention will now be described with reference to FIGS. 1 to 9.

FIG. 1 is a perspective outline view illustrating a drawing apparatus in the present embodiment.

Figure 2:
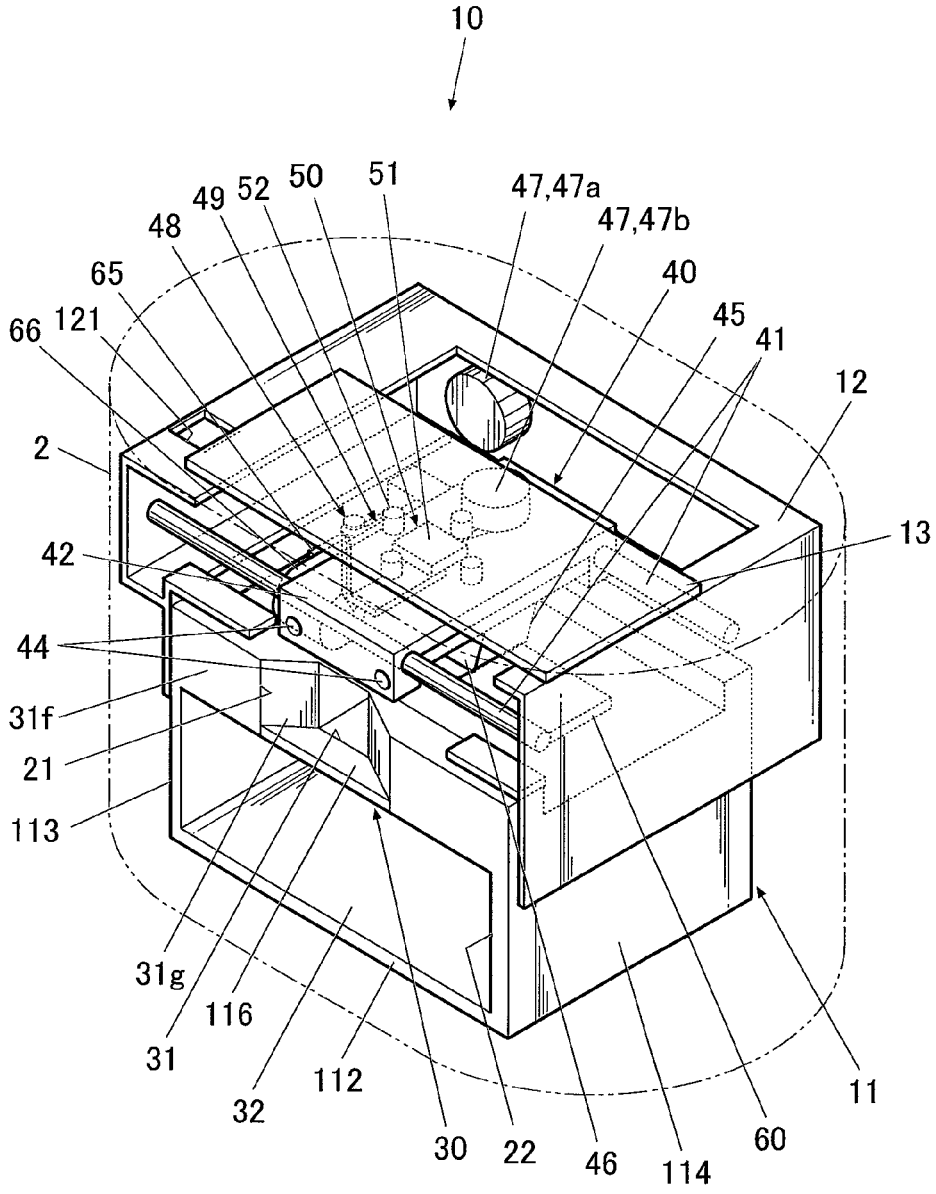
FIG. 2 is a perspective outline view illustrating a apparatus body of the drawing apparatus in FIG. 1.

FIG. 2 is a perspective view illustrating the internal configuration of the drawing apparatus.

As illustrated in FIG. 1, the drawing apparatus 1 is a nail printing apparatus that includes a case main body 2 and a lid unit 4.

The lid unit 4 is pivotably connected to the case main body 2 through a hinge 3 provided in the back end of the top face (top plate) of the case main body 2.

The lid unit 4 is pivotable around the hinge 3 from the lapped state on the top plate of the case main body 2 to the upright state (see FIG. 1) on the top plate of the case main body 2.

The case main body 2 has a substantially elliptic shape in a plain view.

A tiltable door 5 is disposed in the front face of the case main body 2.

The door 5 is connected to the case main body 2 through a hinge (not illustrated) disposed in the front lower end of the case main body 2. The door 5 opens and closes the front of the case main body 2.

The case main body 2 and the lid unit 4 may each have any other shape and configuration.

As illustrated in FIGS. 1 and 2, a first finger opening 21 for inserting a target finger (hereinafter referred to as "a print finger U1") having a nail T on which a pattern is to be drawn is provided in the substantially central front face of the case main body 2.

The first finger opening 21 communicates with a finger receiving section 31 described below.

Below the first finger opening 21 in the front face of the case main body 2, a second finger opening 22 is provided for inserting the other fingers (hereinafter referred to as "the non-print fingers U2") having nails T on which the pattern is not to be drawn (for example, the nail T waiting for the drawing or after the drawing).

The second finger opening 22 communicates with a finger evacuating section 32 described below.

In one side face (the left side face in FIG. 3 in the present embodiment) of the case main body 2, a pen replacing cover 23 that opens and closes a pen replacing opening is provided for replacing a pen 48 of a drawing unit 40 described below.

Figure 3:
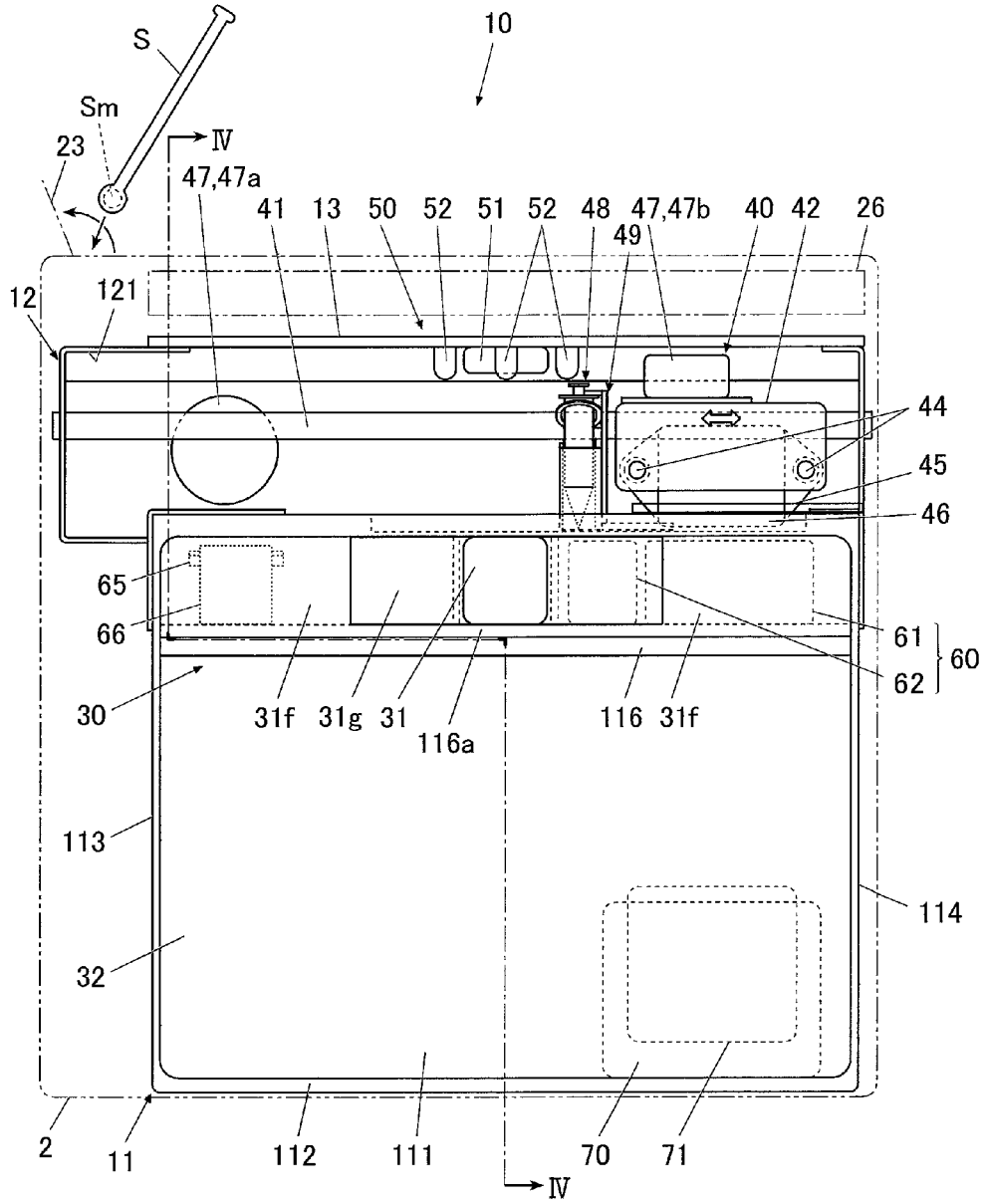
FIG. 3 is a front view of the apparatus body of the drawing apparatus in FIG. 1.

The pen replacing cover 23 is pivotable around, for example, a hinge from the closed state to the opened state as illustrated in FIG. 3.

A pen replacing hole 121 is provided at a position corresponding to the pen replacing cover 23 in one end of an upper frame 12 described below.

The pen replacing opening is preferably connected to the pen replacing hole 121 through a cylinder (not illustrated) extending above the pen 48. According to this configuration, the pen 48 can be smoothly replaced without contact with neighboring components when being attached or detached.

At a position corresponding to a pen preconditioning unit 65 (described below) in the back face of the case main body 2, a medium ejecting opening 24 (see FIG. 4) is provided for replacing, for example, a roll of a long drawing medium 66 placed on the pen preconditioning unit 65.

An operational unit 25 is disposed in the top face (top plate) of the case main body 2.

The operational unit 25 is an input unit receiving various inputs from a user.

The operational unit 25 includes a plurality of switches, such as operational buttons 251 for performing the various inputs, such as a power switch button turning on the power to the drawing apparatus 1, a stop button for stopping the operation, a design selecting button for selecting a design image to be drawn on the nail T, and a drawing start button for instructing the start of drawing.

As shown in FIG. 1, a display unit 26 is provided near the center of top face (top plate) of the case main body 2.

The display unit 26 includes, for example, a liquid crystal display (LCD), an organic electroluminescent display, or any other flat display.

In the present embodiment, the display unit 26 appropriately displays, for example, an image of the finger U1 (hereinafter referred to as "finger image"), a nail image (an image of, for example, the outline line of the nail T) included in the finger image, a design selecting menu for selecting a design image to be drawn on the nail T, a thumbnail image for checking the design, and an instruction menu for displaying various instructions, and the like.

The surface of the display unit 26 may be integrated with a touch panel. In this case, the various inputs can also be performed by an operation of touching the surface of the display unit 26 with, for example, a fingertip, a stylus pen, or a pointed writing rod.

The case main body 2 contains an apparatus body 10 of the drawing apparatus 1.

FIG. 3 is a front view of the apparatus body 10 in the present embodiment.

Figure 4:
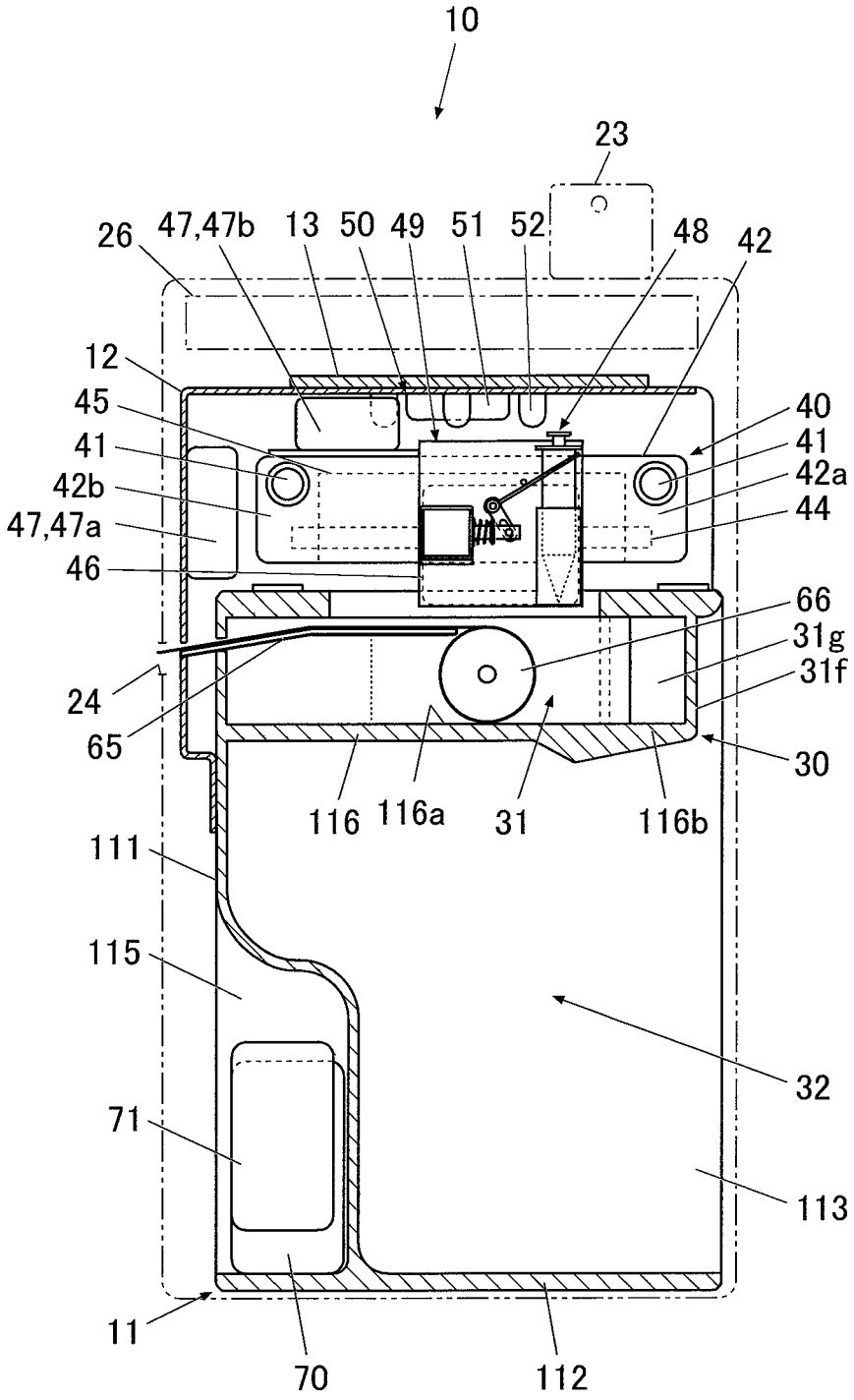
FIG. 4 is a sectional view taken along a line IV-IV in FIG. 3.

FIG. 4 is a sectional view taken in the direction of arrows along a line IV-IV illustrated in FIG. 3.

As illustrated in FIGS. 2 to 4, the apparatus body 10 has a substantial box shape and includes a lower frame 11 provided at the bottom of the case main body 2 and the upper frame 12 provided above the lower frame 11 in the upper part of the case main body 2.

Figure 8:
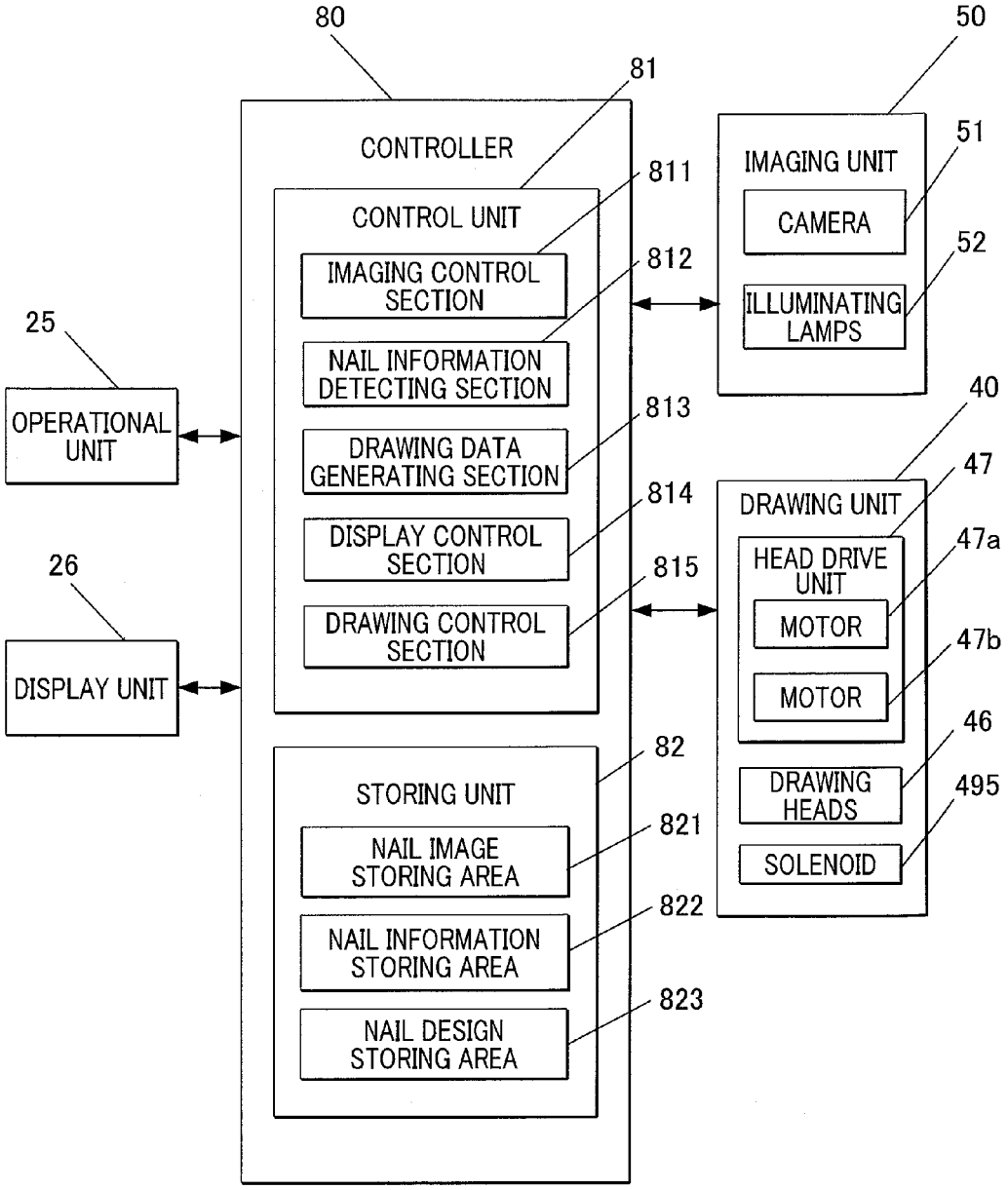
FIG. 8 is a block diagram illustrating main units of a control configuration of the drawing apparatus in the present embodiment.

The lower frame 11 and the upper frame 12 are provided with, for example, a finger fixing unit 30, the drawing unit 40, an imaging unit 50, a head maintenance unit 60, the pen preconditioning unit 65, a cartridge mounting unit 70, and a controller 80 (see FIG. 8).

The lower frame 11 will now be described.

As illustrated in FIGS. 3 and 4, the lower frame 11 has a back plate 111, a bottom plate 112, a pair of right and left side plates 113 and 114, a cartridge container 115, and a partition 116.

The side plates 113 and 114 have lower ends connected to both right and left ends of the bottom plate 112, respectively, and are erected on the bottom plate 112.

The back plate 111 is connected to the back of the bottom plate 112 and the side plates 113 and 114 so as to cover the back of a region surrounded by the bottom plate 112 and the side plates 113 and 114.

The lower part of the back plate 111 is curved toward the front (near side in the inserting direction of the print finger U1) to form a recess. A space formed behind the recessed back plate 111 serves as the cartridge container 115 (see FIG. 4).

The cartridge container 115 contains the cartridge mounting unit 70 on which an ink cartridge 71 is fit.

The partition 116 is provided inside the lower frame 11 to divide a space inside the lower frame 11 (a space surrounded by the back plate 111, the bottom plate 112, and the side plates 113 and 114) into upper and lower parts.

The partition 116 is provided substantially horizontally, has right and left ends connected to the side plates 113 and 114, respectively, and has a back end connected to the back plate 111.

The lower frame 11 is integrated with the finger fixing unit 30.

The finger fixing unit 30 includes the finger receiving section 31 receiving the print finger U1 having the nail T as a drawing target and the finger evacuating section 32 to which fingers (hereinafter referred to as "the non-print fingers U2") other than the print finger 131 are placed.

The finger receiving section 31 is disposed above the partition 116 at a substantial center in the width direction of the lower frame 11.

A space below the partition 116 inside the lower frame 11 serves as the finger evacuating section 32.

The finger receiving section 31 is opened toward the front (near side in the inserting direction of the print finger U1) of and the top of the lower frame 11 and has a lower part serving as a print finger table 116*a* that is a part of the partition 116.

Front walls are provided upright on the top face of the partition 116 to cover the both front lateral sides of the lower frame 11.

A pair of guide walls 31*g* guiding the print finger U1 into the finger receiving section 31 are provide upright on the top face of the partition 116 and come closer each other from the respective ends of the front walls 31*f* adjacent to the center toward the finger receiving section 31.

The user can hold the partition 116 between the print finger U1 inserted into the finger receiving section 31 and the non-print fingers U2 inserted into the finger evacuating section 32. This configuration stably fixes the print finger U1 inserted into the finger receiving section 31.

The present embodiment involves a projection 116*b* projecting downward at the front end of the partition 116.

The projection 116*b* may form a taper portion whose thickness gradually decreases toward the near side and gradually increases toward the back or may have a larger thickness over the entire length than that of the concavity in the back of the partition 116.

The projection 116*b* provided at the front end of the partition 116 defines a space between the partition 116 and a drawing-treated nail or nails T when the non-print finger or fingers U2 are inserted into the finger evacuating section 32. This configuration can avoid the contact of the nail T to the bottom face of the partition 116, contamination of the apparatus by the ink, and scratching up a pattern drawn on the nail T.

The head maintenance unit 60 for maintaining drawing heads 46 in a condition suitable for drawing is provided on one side (the right side in FIG. 3 in the present embodiment) of the finger receiving section 31 on the top face of the partition 116.

The head maintenance unit 60 is preferably provided at substantially the same height as that of the nail T of the print finger U1 inserted into the finger receiving section 31.

The head maintenance unit 60 is disposed within a movable range of the drawing heads 46 and the pen 48 moved by a head drive unit 47 in a plain view.

The head maintenance unit 60 includes, for example, a head cleaning/cap mechanism 61 and/or a waste ink reservoir 62.

The head cleaning/cap mechanism 61, for example, cleans the drawing heads 46 or covers the drawing heads 46 with caps in order to maintain the moisture of the drawing heads 46.

In the present embodiment, the head cleaning/cap mechanism 61 is also provided with a pen cap for covering a pen point 482 of the pen 48 in a non-drawing state. The pen point 482 covered with the pen cap in a non-drawing state can be prevented from drying and can be maintained in a condition suitable for drawing.

The waste ink reservoir 62, for example, receives excess ink ejected from the drawing heads 46 in order to maintain nozzles of the drawing heads 46 in the optimal condition.

The head cleaning/cap mechanism 61 has herein been described as a single unit, but may be separated into a head cleaning mechanism and a cap mechanism that are mutually independent.

The pen preconditioning unit 65 described below for predrawing with the pen 48 is provided within a range drawable with the pen 48 on the other side (a position corresponding to the medium ejection opening 24 in the case main body 2, i.e., the left side in FIG. 3 in the present embodiment) of the finger receiving section 31 on the top face of the partition 116.

The pen preconditioning unit 65 is preferably provided at substantially the same height as that of the nail T of the print finger U1 inserted into the finger receiving section 31.

A roll of the long drawing medium 66 is disposed closer to the front of the apparatus than the pen preconditioning unit 65 (on the right side in FIG. 4).

The drawing medium 66 is appropriately fed to the pen preconditioning unit 65, for example, by a unit length at a time by a medium feeding mechanism (not illustrated).

The medium feeding mechanism may feed the drawing medium 66 automatically or manually.

The pen preconditioning unit 65 is made of a flat plate, and one end adjacent to the front of the apparatus is in contact with the drawing medium 66 while the other end adjacent to the back of the apparatus is disposed near the medium ejection opening 24.

The drawing medium 66 fed by the medium feeding mechanism is placed on the pen preconditioning unit 65.

The drawing medium 66 can be discarded in sequence from the medium ejection opening 24 to the exterior of the apparatus.

The drawing medium 66 placed on the pen preconditioning unit 65 may be of any type usable for preconditioning the pen point 482, such as a roll of paper.

In order to prevent a blur at the start of drawing due to dryness of ink on the pen point 482 or an insufficient amount of ink discharged on the medium, the pen preconditioning unit 65 is used for predrawing a predetermined figure, such as "○" (a circle) or "∞" (an infinity mark), with the pen 48 brought down on the drawing medium 66 to appropriately adjust the pen point 482 before the start of drawing with image data on the nail T.

The predetermined figure for predrawing may be any figure. The figure is preferably a simple figure, such as "○" or "∞", in order to prevent the waste of the ink.

Such predrawing is preferably performed at a position shifted little by little each time within the range of the pen preconditioning unit 65 so as not to make a figure to be drawn overlap a figure previously drawn.

When a portion of the drawing medium 66 placed on the pen preconditioning unit 65 has almost been used for predrawing, the drawing medium 66 is fed toward the medium ejection opening 24 by a unit length at a time by the medium feeding mechanism to place a new portion on the pen preconditioning unit 65. This operation can appropriately prepare for next predrawing.

If a new portion needs to be placed on the pen preconditioning unit 65 in a system manually feeding the drawing medium 66, the display unit 26 preferably displays a message, such as "pull out rolled paper", for prompting the drawing medium 66 to be pulled out.

When the rolled drawing medium 66 is all used up, a new drawing medium 66 can be loaded through a replacement opening (not illustrated) provided, for example, on the side face of the case main body 2.

In this case, the end of the rolled drawing medium 66 is slightly pulled out to be placed on the pen preconditioning unit 65 and set to be exposed by an approximate unit length from the medium ejection opening 24.

The drawing unit 40 mainly provided in the upper frame 12 includes, for example, guide rods 41, a main carriage 42, guide rods 44, a sub-carriage 45, the drawing heads 46, a pen holder 49, the head drive unit 47, and the ink cartridge 71.

More specifically, as illustrated in FIGS. 3 and 4, the two parallel guide rods 41 are disposed between both side plates of the upper frame 12. The main carriage 42 is slidably provided on the guide rods 41.

As illustrated in FIG. 4, the two parallel guide rods 44 are disposed between a front wall 42*a* and a back wall 42*b* of the main carriage 42. The sub-carriage 45 is slidably provided on the guide rods 44. The drawing heads 46 are mounted at the center of the bottom face of the sub-carriage 45.

In the present embodiment, the drawing heads 46 are based on an ink jet system that ejects or discharges ink in the form of fine droplets onto a surface and fixes the ink for drawing an image on the drawing target.

The drawing heads 46 may be based on any recording system other than the ink jet system.

In the present embodiment, the drawing heads 46 of the drawing unit 40 draw an image (for example, a design image) on the basis of drawing data on the surface of the nail T of the print finger U1.

The drawing unit 40 in the present embodiment includes the drawing heads 46 for yellow (Y), magenta (M), and cyan (C) inks, for example. Each drawing head 46 includes a nozzle array having multiple nozzles for ejecting the corresponding color ink.

One drawing head 46 may include a nozzle array for ejecting these three color inks, and the drawing unit 40 may include that one drawing head 46, for example.

The drawing unit 40 may further include drawing heads 46 for ejecting any inks other than these three color inks.

The ink cartridge 71 for the inks ejected from the drawing heads 46 is mounted in the cartridge mounting unit 70 provided in the cartridge container 115, so that the inks in the ink cartridge 71 are appropriately supplied to the drawing heads 46 through the cartridge mounting unit 70 and, for example, ink supply pipes (not illustrated). The ink cartridge may be mounted directly on the drawing heads 46.

The drawing heads 46 in the present embodiment are movable by the head drive unit 47 including, for example, a main scanning motor 47*a* and a sub-scanning motor 47*b* in an X direction that is the width direction (lateral direction) and a Y direction that is the depth direction (front-back direction) of the drawing apparatus 1.

That is, the main carriage 42 is connected to the main scanning motor 47*a* through a power transfer unit (not illustrated) so as to be moved in the lateral direction along the guide rods 41 by forward and backward rotation of the main scanning motor 47*a*.

The sub-carriage 45 is connected to the sub-scanning motor 47*b* through a power transfer unit (not illustrated) so as to be moved in the anteroposterior direction along the guide rods 44 by forward and backward rotation of the sub-scanning motor 47*b*.

In the present embodiment, a penholder 49 for holding the pen 48 for drawing an image on the nail T of the print finger U1 is fixed to the sub-carriage 45 supporting the drawing heads 46.

As illustrated in FIG. 3, the penholder 49 is disposed at the side of the main carriage 42 and has one end fixed at the lower part of the sub-carriage 45.

In the present embodiment, the penholder 49 is fixed on the sub-carriage 45 as described above. This configuration causes the head drive unit 47 in the drawing unit 40 to drive the drawing heads 46 and the pen 48 while maintaining a constant distance therebetween.

In specific, when the drawing heads 46 supported by the sub-carriage 45 move, the penholder 49 fixed on the sub-carriage 45 moves together with the drawing heads 46.

The head drive unit 47 thereby drives the drawing heads 46 and the pen 48 simultaneously.

The penholder 49 may be attached to any position relative to the sub-carriage 45 other than that described above.

Figure 5B:
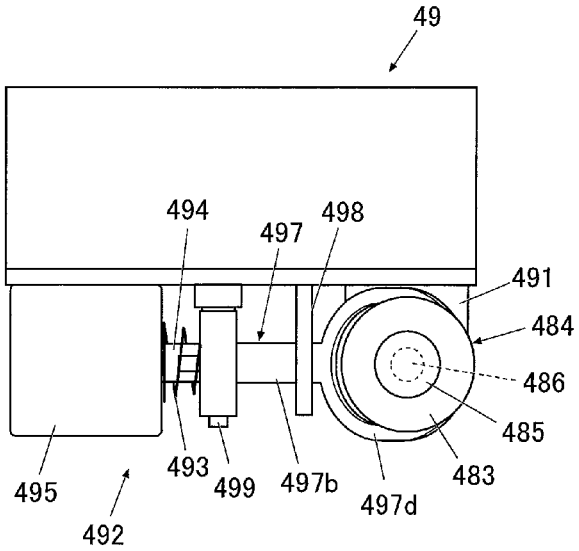
FIGS. 5A to 5C are enlarged views of a penholder and a pen held on the penholder in a non-drawing state.
Figure 5A:
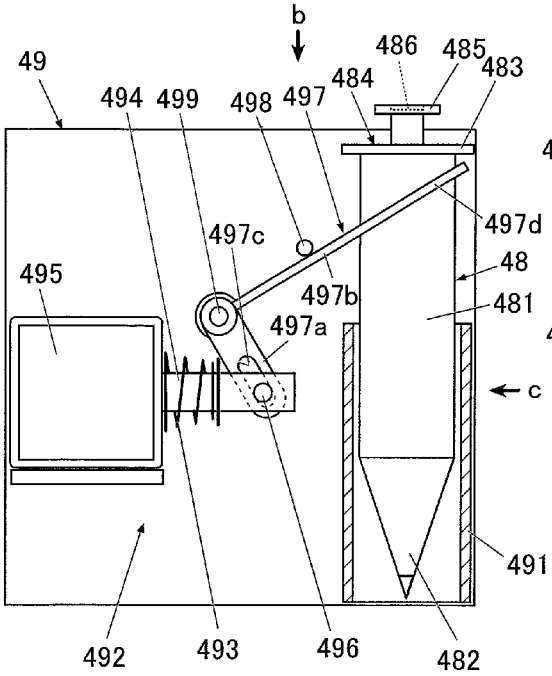
Figure 5C:
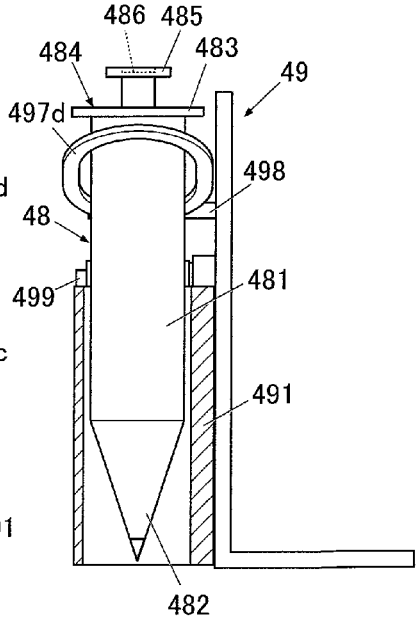

FIGS. 5A to 5C are enlarged views of the penholder 49 and the pen 48 held on the penholder 49 in a non-drawing state.

Figure 6B:
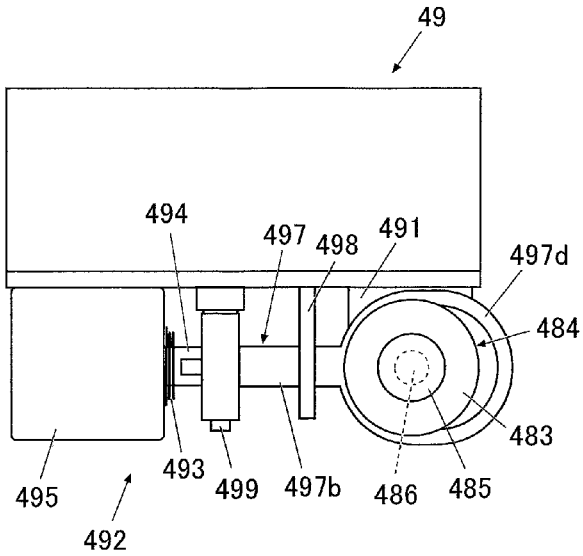
FIGS. 6A to 6C are enlarged views of the penholder and the pen held on the penholder in a drawing state.
Figure 6A:
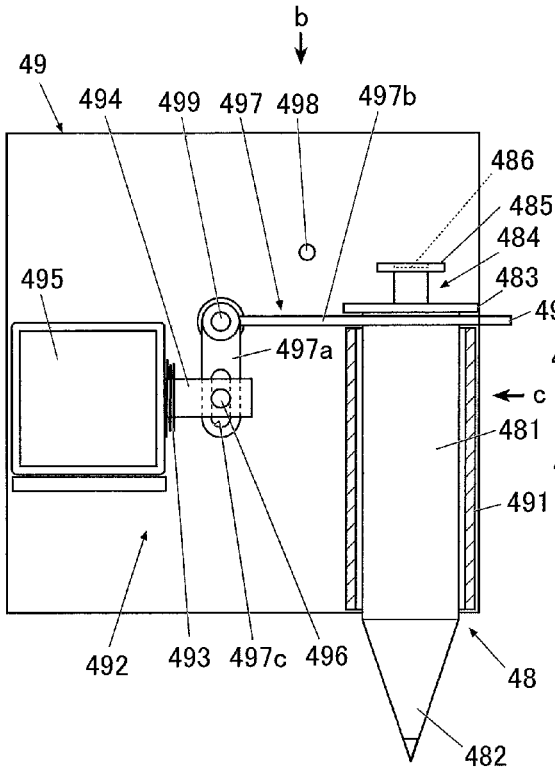
Figure 6C:
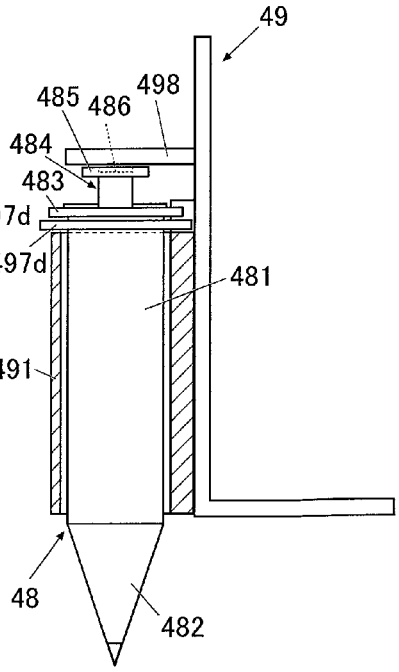

FIGS. 6A to 6C are enlarged views of the penholder 49 and the pen 48 held on the penholder 49 in a drawable state.

FIGS. 5A and 6A are side views of the penholder 49 and the pen 48.

FIGS. 5B and 6B are top views of the penholder 49 and the pen 48 viewed along an arrow b in FIGS. 5A and 6A.

FIGS. 5C and 6C are front views thereof viewed along an arrow c in FIGS. 5A and 6A.

As illustrated in FIGS. 5A to 5C and 6A to 6C, the pen (drawing tool) 48 held on the penholder 49 includes the pen point 482 at the tip of a pen shaft 481.

The interior of the pen shaft 481 of the pen 48 serves as an ink container containing various inks.

The ink contained in the pen shaft 481 may have any viscosity and may contain a color material having any particle diameter (size of particles).

Examples of the ink include gold and/or silver glittering inks, white inks, UV-curable inks and nailing gels, and nail polishes for undercoat or topcoat.

Such an ink has a particle diameter and viscosity that are unsuitable for the drawing head 46 in the ink-jet process.

A cover 484 provided with a flange 483 projecting outward from the pen shaft 481 is attached to the other end of the pen shaft 481.

The pen shaft 481 and the cover 484 may be composed of any material, and is preferably composed of, for example, a resin, which can reduce the weight of the pen 48.

In the present embodiment, a knob 485 is provided at the top of the cover 484 in order to be readily pinched with, for example, a hand or tweezers.

The knob 485 is provided with a small iron piece 486, for example, embedded therein or bonded thereon so as to be attracted by a magnet.

The pen 48 is, for example, used for drawing an image on the surface of the target nail T with the ink, which is contained in the pen shaft 481, discharged by urging the pen point 482 against the surface. Its pen point 482 is a type of a ball-point pen, for example.

The pen 48 may be of any type other than a ball-point pen. The pen 48 may be, for example, a felt pen for drawing an image with ink perfused into a felt pen point or a brush pen for drawing an image with ink perfused into bundled animal or artificial hair.

The pen point 482 may also have any thickness or shape. The thickness and the shape of the pen point 482 may appropriately be selected from, various types according to demand.

As described below, the pen 48 is held on only insertion from above into a pen keeper 497*d* and a supporting cylinder 491 of the penholder 49.

The knob 485 can thereby be pinched with, for example, a hand or tweezers through the opened pen replacing cover 23 provided in the case main body 2 to readily take out and replace the pen 48 with a new one.

In the case of the knob 485 provided with the iron piece 486, for example, a magnet Sm attached to the tip of a stick S as illustrated in FIG. 3 is approached and attracted to the iron piece 486 of the knob 485 through the pen replacing opening and the pen replacing hole 121 connected the opening to pull up the iron piece 486. This procedure can readily replace the pen 48 with a new one.

A user can readily replace the pen 48 held on the penholder 49 with another one of an appropriate pen point 482, ink, or color depending on a nail design desired for drawing. This configuration can achieve a variety of nail designs.

The penholder 49 includes the supporting cylinder 491 holding the pen 48 in a substantially vertical state and a pen up-and-down mechanism 492 for vertically moving the pen 48.

The supporting cylinder 491 has the pen point 482 and the pen shaft 481 inserted thereinto to hold the pen 48.

The pen up-and-down mechanism 492 includes a plunger 494, a solenoid 495, a lever supporting shaft 496, a pen up-and-down lever 497, and a stopper 498.

The plunger 494 is biased by a spring 493 forward (rightward in FIGS. 4, 5A, and 6A).

The solenoid 495 holds the plunger 494 backward (leftward in FIGS. 4, 5A, and 6A) against the biasing force of the spring 493.

The lever supporting shaft 496 is attached to the moving end of the plunger 494.

The pen up-and-down lever 497 is connected to the plunger 494 through the lever supporting shaft 496.

The stopper 498 is provided at a position of avoiding the excess rise of the pen up-and-down lever 497.

As illustrated in FIGS. 5A and 6A, the L-shaped pen up-and-down lever 497 includes a short arm 497*a* substantially orthogonal to a long arm 497*b* while the short arm 497*a* has a long hole 497*c*, with which the lever supporting shaft 496 is engaged, at its tip.

The pen keeper 497*d* for holding the pen 48 is provided in the tip of the long arm 497*b*. The pen keeper 497*d* has a ring shape having an inner diameter larger than the diameter of the pen shaft 481 and the pen point 482 of the pen 48 and smaller than the diameter of the flange 483 of the pen 48. The pen keeper 497*d* holds the flange 483 from the bottom while the pen shaft 481 and the pen point 482 are inserted into the pen keeper 497*d*.

A rotational shaft 499 having one end fixed to the penholder 49 is inserted from the penholder 49 into the intersection of the short arm 497*a* and the long arm 497*b* in the pen up-and-down lever 497.

In the present embodiment, the solenoid 495 is driven to pull the plunger 494 backward against the biasing force of the spring 493 as illustrated in FIG. 6A.

At this time, the pen up-and-down lever 497 engaged with the lever supporting shaft 496 at the plunger 494 is held such that the long arm 497*b* is in a substantially horizontal pose.

In this state, the pen point 482 of the pen 48 is moved lower than the supporting cylinder 491 of the penholder 49 and comes into contact with the surface of the nail T or the drawing medium 61*a* to be ready for drawing, which is in a drawable state.

When the solenoid 495 is not driven and the plunger 494 is released, the released plunger 494 protrudes forward due to the biasing force of the spring 493 as illustrated in FIG. 5A.

At this time, the pen up-and-down lever 497 engaged with the lever supporting shaft 496 at the plunger 494 rotates upward (counterclockwise) around the rotational shaft 499 and stops due to the contact of the long arm 497*b* to the stopper 498. The flange 483 of the pen 48 is thereby pulled up by the pen up-and-down lever 497.

In this state, the pen point 482 of the pen 48 is moved higher than the supporting cylinder 491 of the penholder 49 and is not in contact with the surface of the nail T or the drawing medium 61*a*, which is in a non-drawing state.

The force from the solenoid 495 moving the plunger 494 forward and backward is converted into the force vertically moving the pen 48 through the rotational shaft 499 and the pen up-and-down lever 497 rotating around the shaft.

The pen 48 is only held through the supporting cylinder 491 of the penholder 49 and is not fixed to, for example, the pen up-and-down lever 497, but is downward biased due to the weight of the pen 48.

The pen 48 can thereby be brought down freely along the supporting cylinder 491 until the flange 483 comes into contact with the top face of the pen keeper 497*d*.

The pen 48 is then brought down to bring the pen point 482 into contact with the surface of the nail T or the drawing medium 61*a*, and the pen point 482 is urged against the surface of the nail T or the drawing medium 61*a*.

During drawing of an image with the pen 48 on the nail T, the pen point 482 can freely move in response to the surface shape (for example, the undulation of the surface) of the nail T (following the curved surface or height of the nail T) in a Z direction (i.e., the vertical direction) orthogonal to an X-Y plane on which the print finger U1 is placed.

Figure 7A:
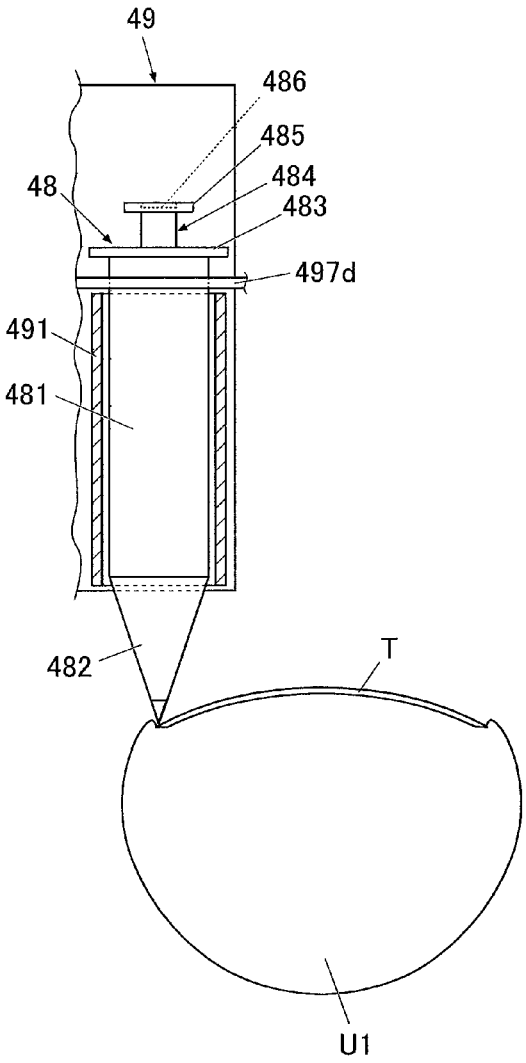
FIG. 7A is a sectional view of the pen in an image-drawing state on a low portion of the nail.

In an example case of drawing on a low portion of the nail T (for example, both ends in the width direction of the nail T), the pen 48 is brought down until the flange 483 is positioned near the top face of the pen keeper 497*d* as illustrated in FIG. 7A.

Figure 7B:
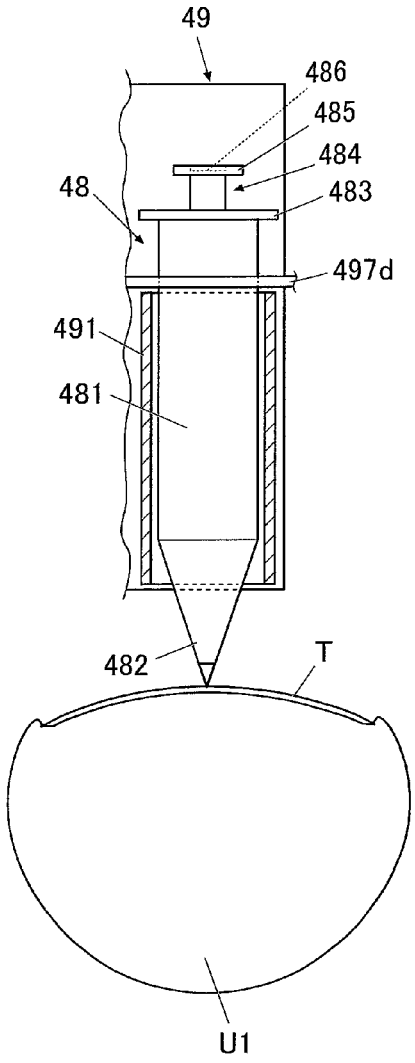
FIG. 7B is a sectional view of the pen in an image-drawing state on a high portion of the nail.

In another case of drawing on a high portion of the nail T (for example, the center in the width direction of the nail T), the pen 48 is brought up in response to the height of the nail T, and the flange 483 is away from the top face of the pen keeper 497*d* as illustrated in FIG. 7B.

The pen 48 weighs several tens of grams, which is extremely light. As a result, if the pen point 482 hits the nail T, the user feels no pain. The drawing pressure of the pen 48 can be secured by the weight thereof to draw a nail design on the nail T.

Among the components included in the pen up-and-down mechanism 492 in the present embodiment, the rotational shaft 496 and the stopper 498 are composed of a metal, such as stainless steel, and the other components are composed of a light material, such as a resin, which is not reactive to a magnet.

Each component of the pen up-and-down mechanism 492 may be composed of any other material.

In the present embodiment, the solenoid 495 is used as an actuator for vertically moving the pen 48. The actuator for vertically moving the pen 48, however, may be of any type other than the solenoid 495. The light pen 48 can be moved vertically by an actuator including any other type of small driving device instead of a solenoid.

As illustrated in FIGS. 2 to 4, the imaging unit 50 is provided in the upper frame 12.

More specifically, a substrate 13 is disposed in the upper frame 12, and a camera 51 is disposed at the center of the bottom face of the substrate 13.

The camera 51 preferably has approximately 2 million pixels, for example.

The camera 51 is an imaging device taking an image of the nail T (the print finger U1 including the nail T) of the print finger U1 inserted into the finger receiving section 31.

The illuminating lamps (lighting devices) 52, such as white LEDs, are disposed on the substrate 13 so as to surround the camera 51. The illuminating lamps 52 illuminate the nail T of the print finger U1 when the nail T is imaged with the camera 51. The imaging unit 50 includes the camera 51 and the illuminating lamps 52.

In the present embodiment, based on an image (a finger image including a nail image) of the nail T of the print finger U1 taken with the camera 51 as an imaging device, a nail information detecting section 812 (see FIG. 8) described below detects nail information, such as the shape, the position (including the horizontal and vertical position of the nail T), and the curvature of the nail T.

The imaging unit 50 is connected to an imaging control section 811 (see FIG. 8) of the controller 80 described below and is controlled by the imaging control section 811.

The data of an image taken with the imaging unit 50 is stored in a nail image storing area 821 of the storing unit 82 described below.

The controller 80 is disposed, for example, on the substrate 13 disposed in the upper frame 12.

FIG. 8 is a block diagram illustrating a relevant portion of a control configuration in the present embodiment.

As illustrated in FIG. 8, the controller 80 is a computer including a control unit 81 having a central processing unit (CPU) (not illustrated) and the storing unit 82 having, for example, a read only memory (ROM) and a random access memory (RAM), which are not illustrated.

The storing unit 82 stores, for example, various programs for operating the drawing apparatus 1 and various pieces of data.

More specifically, the ROM of the storing unit 82 stores, for example, various programs, such as a nail information detecting program for detecting nail information such as the shape, the position, and the curvature of the nail T from the nail image, a drawing data generating program for generating data for drawing, and a drawing program for performing a drawing process. The controller 80 performs the programs to control each component of the drawing apparatus 1.

In the present embodiment, the storing unit 82 includes the nail image storing area 821 storing the nail image of the nail T of user's print finger U1 taken with the imaging unit 50, a nail information storing area 822 storing nail information detected by the nail information detecting section 812, and a nail design storing area 823 storing image data of a nail design to be drawn on the nail T.

The control unit 81 functionally includes the imaging control section 811, the nail information detecting section 812, a drawing data generating section 813, a display control section 814, and a drawing control section 815, for example.

The functions of, for example, the imaging control section 811, the nail information detecting section 812, the drawing data generating section 813, the display control section 814, and the drawing control section 815 are implemented by cooperation of the CPU of the control unit 81 with the programs stored in the ROM of the storing unit 82.

The imaging control section 811 controls the camera 51 and the illuminating lamps 52 of the imaging unit 50 to take an image of the nail T of the print finger U1 inserted into the finger receiving section 31 with the camera 51.

The nail information detecting section 812 detects information on the nail T of the print finger U1 on the basis of the image, which is taken with the camera 51, of the nail T of the print finger U1 inserted into the finger receiving section 31.

This nail information includes the outline (the shape and the horizontal position of the nail), the height (the vertical position of the nail T, hereinafter also referred to as the "vertical position of the nail T" or the "position of the nail T" simply), and the curvature (nail curvature) of the nail T.

The nail information detecting section 812 detects at least any one of the shape, the position, and the curvature of the nail T as the nail information.

In the present embodiment, the nail information detecting section 812 detects all of the shape, the position, and the curvature of the nail T based on the nail image.

More specifically, the nail information detecting section 812 detects the outline (shape and size) and the position of the nail T from the finger image, which is taken with the camera 51, including the nail image of the nail T of the print finger U1, and acquires information representing the outline, for example, on, the x-y coordinate system.

The nail information detecting section 812 detects the outline (shape) of the nail T from the finger image, which is taken with the camera 51, including the nail image of the nail T of the print finger U1 on the basis of, for example, the difference in color between the nail T and the other finger portions.

The method how the nail information detecting section 812 detects the outline (shape) of the nail T is not limited to those described here and the nail information detecting section 812 may also detect the outline (shape) of the nail T in any other manner.

The nail information detecting section 812 detects the nail height of the nail T based on the image of the nail T taken with the camera 51. The nail height is defined as the vertical position of the nail T.

The nail information detecting section 812 also detects the nail curvature of the nail T based on the image of the nail T taken with the camera 51. The nail curvature is defined as the curvature in the width direction of the nail T.

The nail information detecting section 812 can estimate the nail height and the nail curvature of the nail T from, for example, a change in the shade appearing in the nail image of the nail T taken from two different angles with the camera 51.

The nail information detecting section 812 also may detect the height and the curvature of the nail T in any other manner.

The drawing data generating section 813 generates data for drawing on the nail T of the print finger U1 with the drawing heads 46 based on the nail information detected by the nail information detecting section 812.

More specifically, the drawing data generating section 813 performs a fitting process of, for example, zooming in and out of the image data of a nail design based on the nail information, such as the shape of the nail T, detected by the nail information detecting section 812, and generates data for drawing on the nail T.

The display control section 814 controls the display unit 26 to display various menus and images on its screen.

In the present embodiment, the display control section 814 displays, for example, a menu for selecting a nail design, a thumbnail image for checking the design, a finger image of the print finger U1, a nail image included in the finger image, and various instruction menus on the screen on the display unit 26.

The drawing control section 815 outputs the drawing data generated by the drawing data generating section 813 to the drawing unit 40 and controls the operations of the main scanning motor 47*a* and the sub-scanning motor 47*b* functioning as the head drive unit 47 of the drawing unit 40, the drawing heads 46, and the solenoid 495 vertically moving the pen 48 to perform drawing on the nail T based on the drawing data.

The operation of the drawing apparatus 1 and a method for controlling drawing in the present embodiment will now be explained.

For drawing with the drawing apparatus 1, the user turns on the power switch to start the controller 80.

The display control section 814 displays the design selecting menu on the display unit 26.

The user operates, for example, the operational buttons 251 in the operational unit 25 to select a desired nail design from multiple nail designs appearing on the design selecting menu.

In response to this operation, selecting instruction signals are outputted from the operational unit 25 to select the nail design to be drawn on the nail T.

After the nail design is selected, the control unit 81 displays on the display unit 26 the instruction menu for prompting the pen 48 necessary for drawing the selected nail design to be set in the penholder 49.

The user sets the predetermined type of pen 48 in the penholder 49 according to the instructions in the menu appearing on the display screen.

The user may daringly set the pen 48 not according to the instructions to acquire a nail design with desired color or texture.

The control unit 81 may read the type of pen 48 set in the penholder 49 from, for example, a bar code on the pen 48. In this case, nail designs drawable with the pen 48 set in the penholder 49 may be displayed on the design selecting menu on the display unit 26 to prompt the user to select a nail design from the nail designs, for example.

The user then inserts the print finger U1 into the finger receiving section 31 and the non-print fingers U2 into the finger evacuating section 32. The user then operates the switch on the operational unit 25 while the print finger U1 is fixed to an appropriate position.

If the instruction of start of drawing is inputted through the drawing start switch button, the imaging control section 811 controls the imaging unit 50 and causes the camera 51 to take an image of the print finger U1 while the print finger U1 is being illuminated by the illuminating lamps 52, before the start of the drawing operation.

The imaging control section 811 thereby takes the image of the nail T of the print finger U1 inserted into the finger receiving section 31.

The nail information detecting section 812 then detects (calculates) the outline (nail shape and size), the position (including the vertical position of the nail), and the nail curvature of the nail T based on the image of the nail T.

After the nail information detecting section 812 detects the shape, the position, and the curvature of the nail T, the drawing data generating section 813 performs the fitting process on the image data of the nail design for the nail T based on the detected nail information.

The drawing data generating section 813 corrects a curved surface to be fit to the image data of the nail design based on the nail information and thereby generates drawing data.

The drawing control section 815 moves the pen 48 to the pen preconditioning unit 65 before the start of drawing on the nail T. The drawing control section 815 then drives the solenoid 495 of the penholder 49 holding the pen 48 to bring the pen point 482 of the pen 48 into contact with the drawing medium 66 (drawable state).

The pen 48 is then moved in this state to draw (predraw) a predetermined pattern, such as "○" or "∞", on the drawing medium 66 to condition the pen 48 beforehand.

After the generation of the drawing data and the predrawing, the drawing control section 815 moves the pen 48 onto the nail T. The drawing control section 815 then outputs the drawing data to the drawing unit 40 and appropriately drives the drawing heads 46 and the solenoid 495 of the penholder 49 to draw the nail design based on the drawing data on the nail T.

On a portion to be drawn by the ink jet system, the drawing heads 46 eject an appropriate amount of predetermined color ink and are appropriately moved in the X-Y directions to draw the design on the nail T.

On another portion to be drawn with the pen 48, the solenoid 495 of the penholder 49 is driven to bring the pen 48 into a drawable state, and the penholder 49 is appropriately moved in the X-Y directions by the head drive unit 47 on the basis of the drawing data to draw the image on the nail T.

At this time, the pen 48 is urged against the surface of the nail T due to its own weight to draw the image while vertically moving in response to the surface shape of the nail T.

In order to draw images on the nails T of two or more fingers, after the drawing process is completed on the nail T of a first finger, the first finger is pulled out of the finger receiving section 31. The finger having the nail T for the next drawing is then inserted as the print finger U1 into the finger receiving section 31 to take an image of the nail T, and the above-described processes are repeated.

After the drawing is completed, the drawing control section 815 moves the drawing heads 46 above the drawing head maintenance unit 60. The drawing heads 46 and the pen 48 are covered with the caps and are prevented from being dry.

In order to replace the pen 48, the drawing control section 815 moves the penholder 49 to a position corresponding to the pen replacing cover 23. In this state, the user can open the pen replacing cover 23 to take out and replace the pen 48 with another one.

Figure 9A:
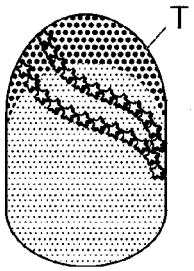

FIGS. 9A to 9D2 illustrate exemplary nail designs drawable on the nail T with the drawing apparatus 1 in the present embodiment.

FIG. 9A illustrates a nail design obtained by drawing a pattern on the entire nail T with the ink jet drawing heads 46 and then drawing another pattern on the surface with the pen 48.

In this case, the user applies white undercoat (also serving as an ink accepting layer) on the entire nail T.

After the white undercoat is dried, a design serving as the background is selected with the drawing apparatus 1, and the print finger U1 is placed on the drawing apparatus 1 to draw the selected design (the design including, for example, light pink depicted on the entire nail and deep color, such as red, depicted only on the tip of the nail in FIG. 9A) is drawn with the drawing heads 46.

After the ink is dried for a while, the print finger U1 is placed on the drawing apparatus 1 again to select a design to be drawn with the pen 48.

The pen 48 (containing gold and silver glittering ink in the example illustrated in FIG. 9A) suitable for the selected design (including small gold ball patterns in FIG. 9A) is then mounted on the penholder 49 to draw the design with the pen 48.

In this case, the pen 48 preferably contains ink including a solvent not affecting the ink used for the ink jet drawing heads 46.

Clear topcoat is then applied and dried to achieve durable nail print.

The drawing apparatus 1 in the present embodiment involves the pens 48 having various types of pen points 482 as described above and therefore may also draw an image, for example, for white undercoat or topcoat with the pen 48, such as a ball-point pen, a felt pen, or a brush pen, having a comparatively thick pen point 482.

In this case, the user can cut out the need of painting the nail by him/herself and can achieve an excellent finish without, for example, undrawn and uneven portions on the entire nail T.

Figure 9B:
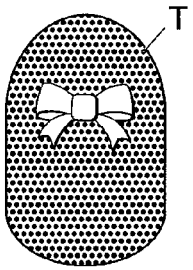

FIG. 9B illustrates an exemplary nail design drawn with only the pen 48 without use of the ink jet drawing heads 46.

The nail design in FIG. 9B is obtained, for example, by applying a nail polish having deep color, such as red, on the nail T and drawing a ribbon pattern thereon with the pen 48 and gold glittering ink.

The ink jet drawing heads 46 cannot develop some color without previously applying undercoat, such as white. Such color, however, can appropriately and beautifully be developed by drawing with the pen 48 by applying ink having, for example, high viscosity and an excellent color developing property without application of white undercoat to cover the original color of the target.

Figure 9C:
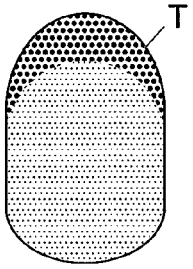
Figure 9C:
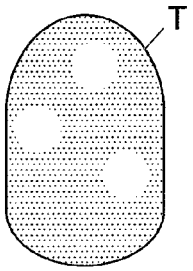
Figure 9C:
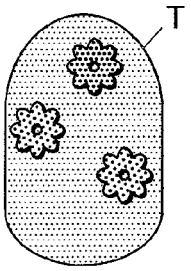

FIG. 9C illustrates an exemplary French nail achieved by coloring only the tip of the naked nail T with the pen 48.

Various designs, such as the French nail, can also be drawn with the pen 48 on the nail T, for example, uncoated with undercoat or coated with a deep color nail polish.

FIG. 9D1 illustrates undercoat for covering drawn with the pen 48 containing white ink on portions of a naked nail T or a nail T with a nail polish.

FIG. 9D2 illustrates an exemplary nail design obtained by drawing flower patterns on the portions coated with the white ink in FIG. 9D1 with the ink jet drawing heads 46. In this case, the regions, on which the flower patterns are to be drawn with the ink jet drawing heads 46, are coated with the white ink and the pen 48.

The nail T of the print finger U1 is recognized and the white portions of the print finger U1 are then detected along with the recognition of the nail T.

Colored flower patterns are then drawn with the ink jet drawing heads 46 to be aligned with the positions and the sizes of the white portions.

In this case, the ink jet drawing heads 46 preferably contain ink including a solvent not affecting the ink used for the pen 48.

Clear topcoat is then applied and dried to achieve durable nail print.

This procedure enables a design including, for example, a full color pattern on a naked nail T or a nail T with a desired nail polish.

When an image is drawn with the ink jet drawing heads 46 after undercoat for covering is drawn with white ink using the pen 48 in this way, the color of the nail T or an undercoat nail polish is preferably recognized on the basis of an image taken with the camera 51 to draw patterns with the drawing heads 46 while the gap between the patterns or the peripheries of the patterns are coated or gradated with the recognized color to be inconspicuous.

As described above, according to the drawing apparatus 1 of the present embodiment, the drawing heads 46 and the pen 48 can integrally and simultaneously be driven while maintaining a constant distance therebetween, and a nail design can be drawn with a combination of the drawing heads 46 and the pen 48.

The apparatus thus can use inks containing a color material having a comparatively large particle diameter or inks having comparatively high viscosity (for example, gold and/or silver glittering inks, and white inks), which cannot be used for an ink jet drawing head, which cannot be used in conventional drawing processes using only ink jet drawing heads.

This configuration can appropriately and beautifully develop the color of ink without application of undercoat, such as white, to eliminate an operation for applying undercoat and can also draw a design utilizing, for example, the original color of the nail T to increase types of drawable nail designs.

For example, the pen 48 having the thick pen point 482 or based on a brush pen type can also be used to quickly apply undercoat and topcoat or color the entire nail T without unevenness.

As a result, the user does not need to apply, for example, undercoat by him/herself and can excellently finish artistic nail painting without impaired image quality due to, for example, undrawn and uneven portions.

Since many types of inks can be used for the pen 48, the drawing apparatus 1 can readily make a variety of sophisticated nail prints comparable with those applied in nailariums on the nail T with a combination of the drawing heads 46 and the pen 48. Such a variety of nail prints includes, for example, gorgeous designs with glittering inks and luxurious designs with a feeling of solidity and gloss.

The pen 48 can use inks, such as UV-curable nailing gels, having high viscosity to therefore achieve excellent and durable manicure like that applied in nailariums.

Not only the pen 48 but also the drawing heads 46 can be used together for drawing an image to therefore achieve nail prints including a colorful pattern drawn in full color readily.

Since the nail information detecting section 812 detects information on at least any one (all in the present embodiment) of the shape, the position, and the curvature of the nail based on the nail image, an image can be drawn depending on the nail T of the user to achieve excellent manicure without undrawn portions and protruding inks.

Second Embodiment

A drawing apparatus according to a second embodiment of the present invention will now be described with reference to FIGS. 10 to 15.

The present embodiment is identical to the first embodiment except for the configuration of pens and penholders in the drawing apparatus. Hereinafter, components different from those in the first embodiment will be described.

Figure 10:
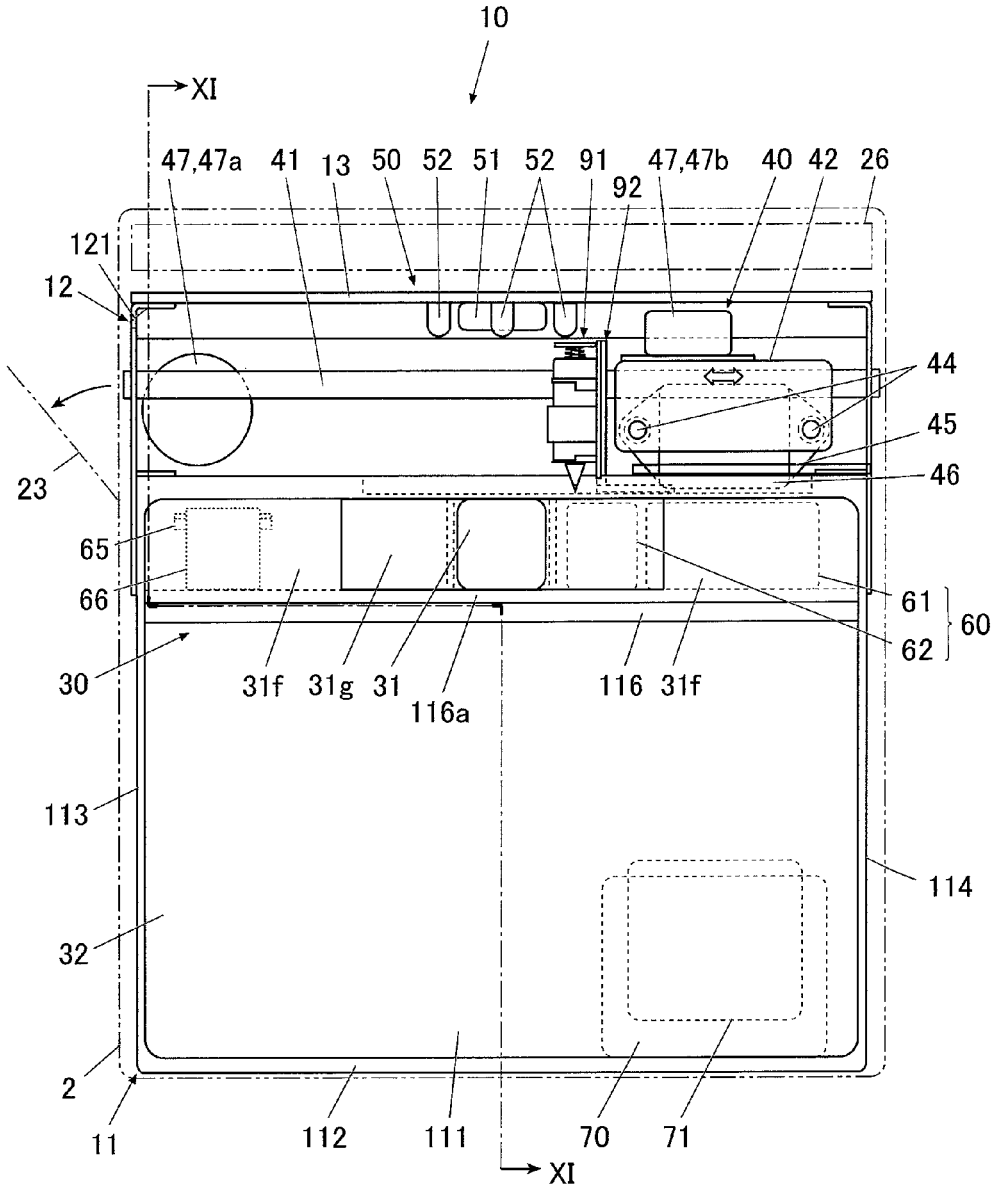
FIG. 10 is a front view of a body of a drawing apparatus in a second embodiment.

FIG. 10 is a front view of the body of the drawing apparatus in the present embodiment.

Figure 11:
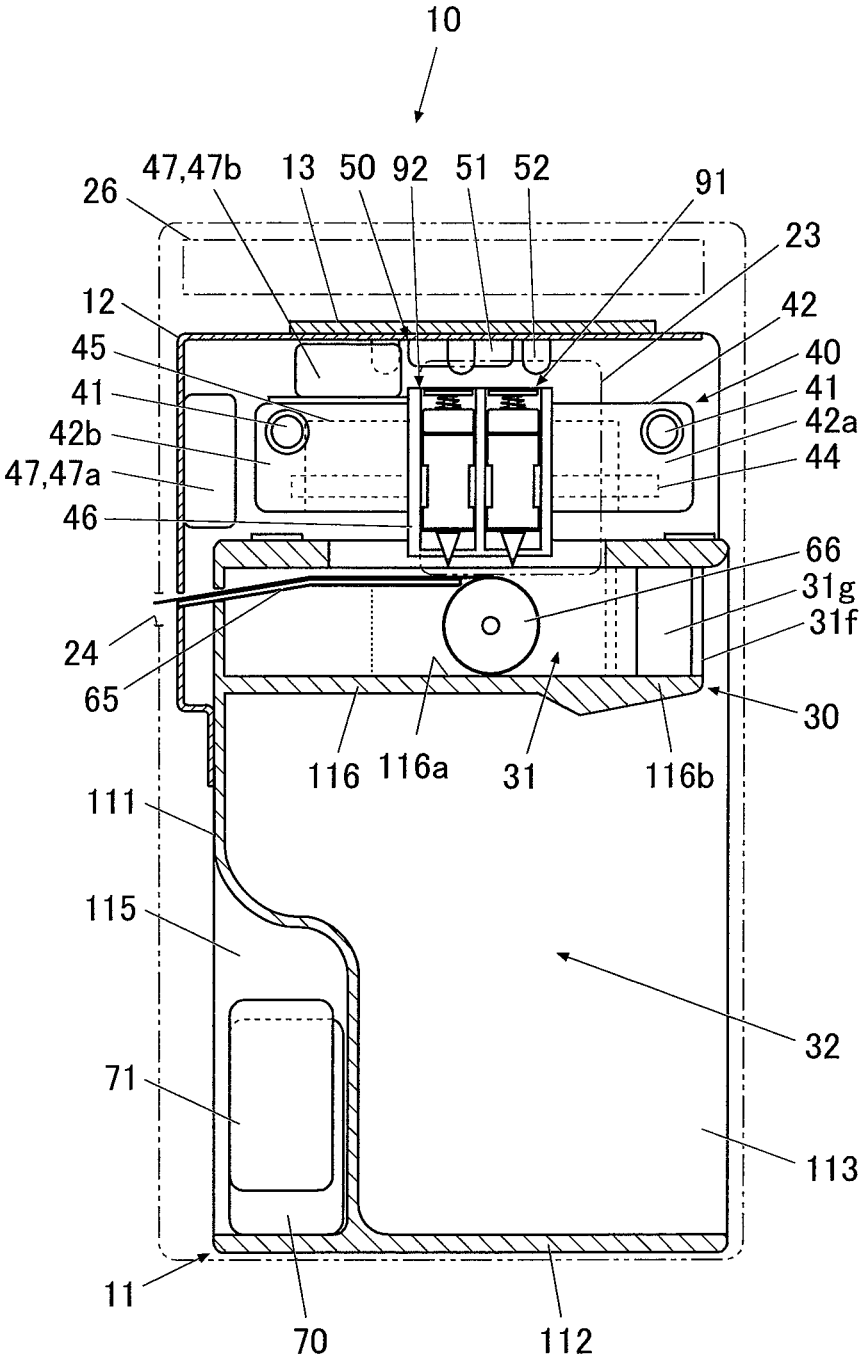
FIG. 11 is a sectional view taken along a line XI-XI in FIG. 10.

FIG. 11 is a sectional view taken in the direction of arrows along a line XI-XI in FIG. 10.

As illustrated in FIG. 10 and FIG. 11, the drawing apparatus in the present embodiment includes a case main body 2 and the apparatus body 10 including a lower frame 11 and an upper frame 12, which have almost the same configurations as those in the first embodiment.

At a position corresponding to pens 91 (described below) in one side face of the case main body 2, an openable pen replacing cover 23 is provided for replacing the pens 91.

The pen replacing cover 23 is pivotable around, for example, a hinge from the closed state to the opened state as illustrated in FIG. 10.

In the present embodiment, a sub-carriage 45 supporting drawing heads 46 is provided with two penholders 92 for holding the respective pens 91 for drawing an image on a nail T of a print finger 131.

As illustrated in FIGS. 10 and 11, the two penholders 92 are abreast disposed at the side of a main carriage 42.

The two penholders 92 each have one end fixed at the lower part of the sub-carriage 45.

The number of the penholders 92 is not limited to two. More than two penholders 92 may also be provided.

In the present embodiment, the penholders 92 are fixed on the sub-carriage 45 as described above. This configuration causes the head drive unit 47 in the drawing unit 40 to drive the drawing heads 46 and the pens 91 while maintaining a constant distance therebetween.

Since the drawing heads 46 supported by the sub-carriage 45 move together with the penholders 92 fixed on the sub-carriage 45, the head drive unit 47 drives the drawing heads 46 and the pens 91 simultaneously.

The penholders 92 may also be attached to any other position.

Figure 12A:
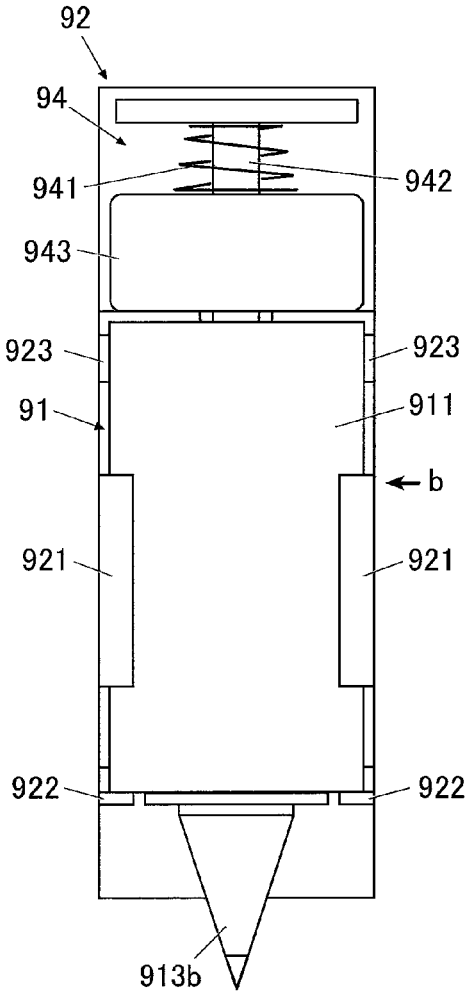
FIG. 12A is an enlarged front views of a pen and a penholder in the second embodiment.

FIG. 12A is a front view of the pen 91 held on the penholder 92.

Figure 12B:
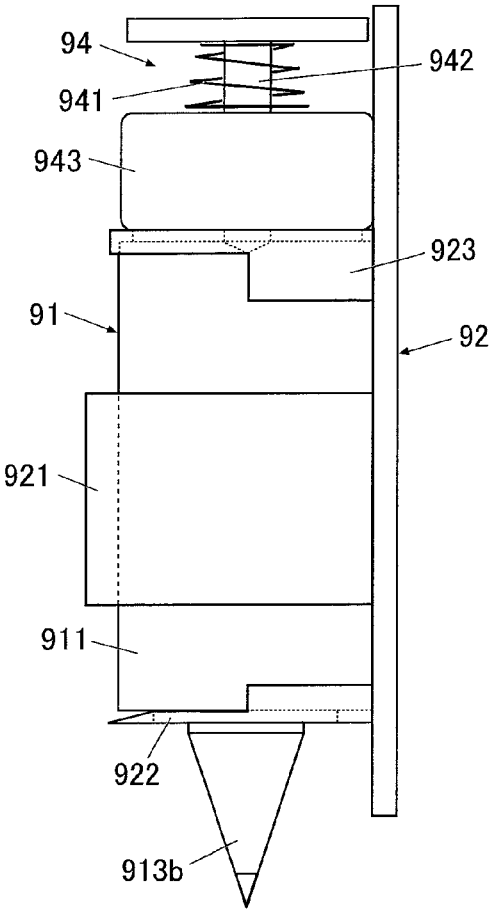
FIG. 12B is an enlarged side view of the pen and the penholder viewed along an arrow b in FIG. 12A.

FIG. 12B is a side view of the penholder 92 and the pen 91 viewed along an arrow b in FIG. 12A.

As illustrated in FIGS. 12A and 12B, the penholder 92 in the present embodiment includes fixers 921 supporting the pen 91 from both sides, lower supporters 922 supporting the pen 91 from both sides of the bottom face, and upper supporters 923 supporting the pen 91 from both sides of the top.

The fixers 921 are made of, for example, thin resin plates having spring resilience. The pen 91 can thereby be attached to and detached from the penholder 92 readily by pushing force applied from the outer circumference of the pen 91 to the fixers 921 to be expanded toward both sides.

The pen 91 can be supported from both sides by the lower supporters 922 and the upper supporters 923 to stabilize the vertical position of the pen 91 and is supported by the lower supporters 922 to be prevented from falling.

At the top of the penholder 92, a pen up-and-down mechanism 94 is provided for vertically moving the pen 91 held on the penholder 92.

The pen up-and-down mechanism 94 includes a plunger 942 and a solenoid 943.

The plunger 942 is biased by a spring 941 upward (upward in FIGS. 12A and 12B).

The solenoid 943 holds the plunger 942 downward against the biasing force of the spring 941.

In the present embodiment, the lower end of the plunger 942 has, for example, a hemispherical or conical shape.

As described below, a shaft receiving recess 912*a* is provided at the top of the pen 91. The lower end of the plunger 942 having, for example, a hemispherical or conical shape can therefore be received at the shaft receiving recess 912*a* of the pen 91 to vertically press down the pen 91 stably.

Figure 13A:
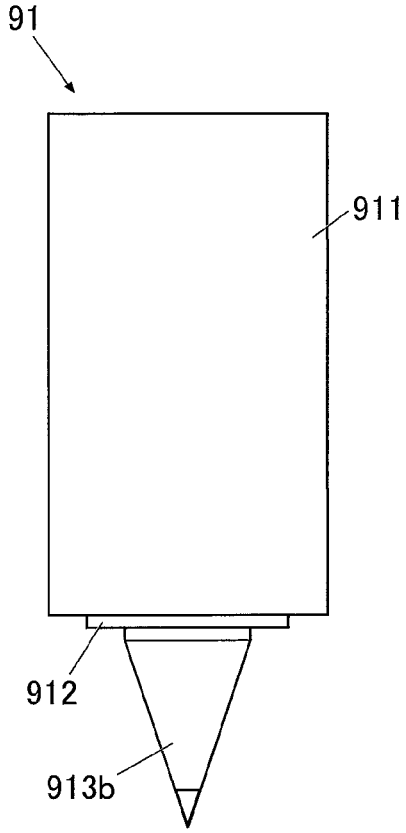
FIG. 13A is a plane view of the pen in the second embodiment.

FIG. 13A is a side outline view illustrating the pen 91 held on the penholder 92 in the present embodiment.

Figure 13B:
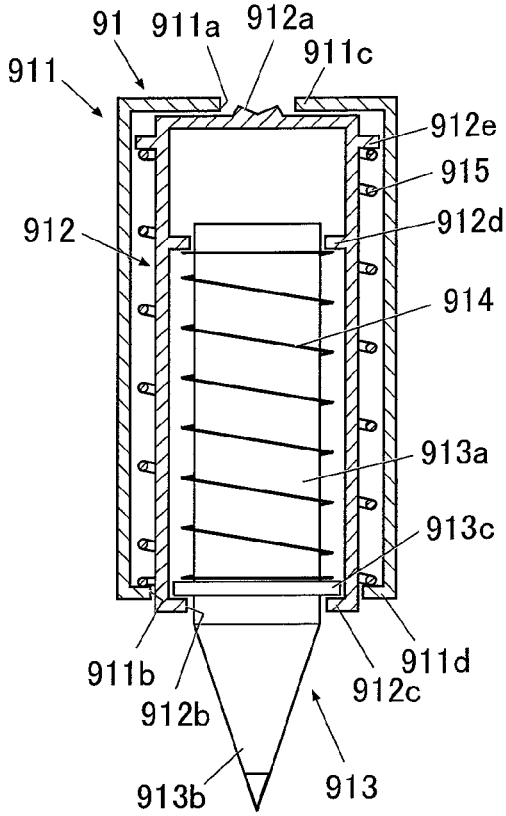
FIG. 13B is a sectional view of the pen in FIG. 13A.

FIG. 13B is a sectional view of the pen 91 illustrated in FIG. 13A.

As illustrated in FIGS. 13A and 13B, the pen 91 includes an outer cylinder 911, an inner cylinder 912 contained in the outer cylinder 911, and a pen body 913 contained in the inner cylinder 912.

The outer cylinder 911 has openings at the top and the bottom while an inward flange 911*c* is provided at the upper opening 911*a*.

An inward flange 911*d* is provided at the lower opening 911*b*.

At a portion, which is exposed from the upper opening 911*a* of the outer cylinder 911, at the top of the inner cylinder 912, the shaft receiving recess 912*a* is provided for receiving the lower end of the plunger 942.

The inner cylinder 912 has an opening 912*b* at the bottom. The inward flange 912*c* is provided at the opening 912*b*.

An inward flange 912*d* extending inward from the inner cylinder 912 is provided in the upper part of the inner cylinder 912.

An outward flange 912*e* extending outward from the inner cylinder 912 is provided outside the top of the inner cylinder 912.

The inner cylinder 912 has an outer diameter smaller than the inner diameter of the lower opening 911*b* of the outer cylinder 911, and the inner cylinder 912 can protrude from the lower opening 911*b* of the outer cylinder 911.

The pen body 913 includes the pen point 913*b* at the tip (at the bottom in FIG. 13A) of the pen shaft 913*a*.

The interior of the pen shaft 913*a* serves as an ink container containing various inks.

A flange 913*c* projecting outward is provided between the pen shaft 913*a* and the pen point 913*b*.

The flange 913*c* has an outer diameter larger than the inner diameter of the opening 912*b* of the inner cylinder 912. Since the flange 913*c* comes into contact with the inward flange 912*c* provided at the opening 912*b* of the inner cylinder 912, the pen body 913 contained in the inner cylinder 912 is held so as not to fall down from the bottom.

A coil spring 914 is wound around the outer circumference of the pen body 913.

The coil spring 914 has one end abutting the top face of the flange 913*c* and the other end abutting the bottom face of the inward flange 912*d* of the inner cylinder 912.

The pen body 913 is biased by the coil spring 914 in the direction (downward in FIGS. 13A and 13B) of the pen point 913*b* protruding from the opening 912*b* of the inner cylinder 912.

Since the pen body 913 is also biased downward by its own weight, the coil spring 914 only needs to apply significantly small biasing force.

A coil spring 915 is wound around the outer circumference of the inner cylinder 912. The coil spring 915 has one end abutting the top face of the inward flange 911*d* provided at the lower opening 911*b* of the outer cylinder 911 and the other end abutting the bottom face of the outward flange 912*e* of the inner cylinder 912. The inner cylinder 912 is biased by the coil spring 915 in the direction (upward in FIGS. 13A and 13B) of the inner cylinder 912 being urged against the bottom face of the inward flange 911*c* provided at the upper opening 911*a* of the outer cylinder 911.

Figure 14A:
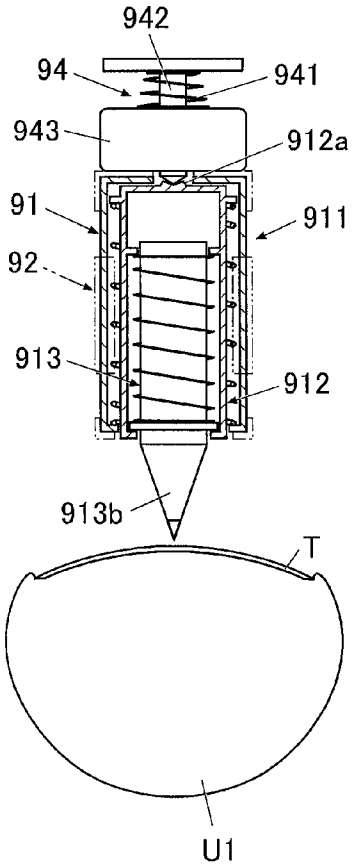
FIGS. 14A to 14C are sectional views of the pen in a non-drawing state, in an image-drawing state on a low portion of the nail, and in an image-drawing state on a high portion of the nail, respectively.
Figure 14B:
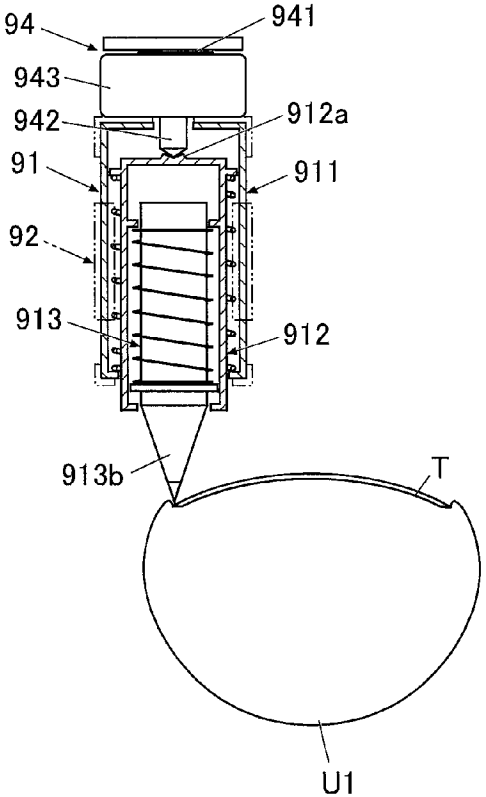
Figure 14C:
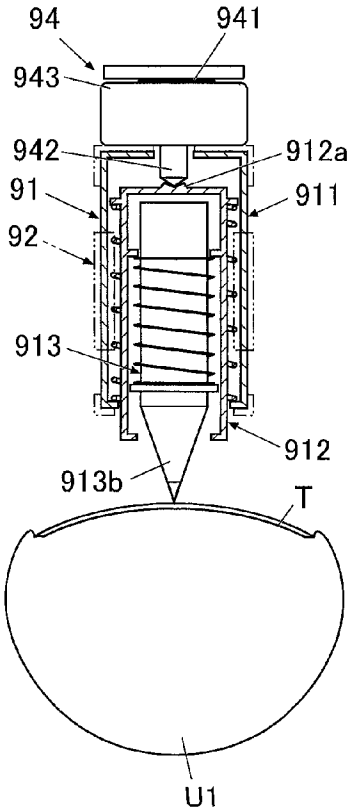

FIGS. 14A to 14C illustrate the relationships between the operations of the pen up-and-down mechanism 94 and the vertical movements of the pen 91.

As illustrated in FIG. 14A, the plunger 942 of the pen up-and-down mechanism 94 does not come into contact with the shaft receiving recess 912*a* of the pen 91 in a non-drawing state. At this time, the inner cylinder 912 of the pen 91 is pushed upward by the biasing force of the coil spring 915 such that the pen point 913*b* does not protrude downward.

In a drawable state, the solenoid 943 of the pen up-and-down mechanism 94 operates to push the plunger 942 downward. The tip of the plunger 942 thereby comes into contact with the shaft receiving recess 912*a* of the pen 91 as illustrated in FIGS. 14B and 14C. The inner cylinder 912 is then pushed downward against the biasing force of the spring 941. As a result, the pen point 913*b* comes into contact with the surface of the nail T. The pen body 913 is biased downward by the coil spring 914 to press the pen point 913*b* against the surface of the nail T with appropriate force to lead to a drawable state.

Since the biasing force of the coil spring 914 is small, the pen body 913 is upward pushed against the biasing force of the coil spring 914 at and by a high portion of the surface of the nail T as illustrated in FIGS. 14B and 14C. In this way, the pen body 913 can move in response to the surface shape of the nail T in a Z direction (for example, upward in FIG. 14C) orthogonal to an X-Y plane.

The other components are the same as those of the first embodiment and are therefore designated with the same reference numerals without redundant description.

The operation of the drawing apparatus 1 and a method for controlling drawing with this apparatus in the present embodiment will now be explained.

For drawing an image with the drawing apparatus 1, the user first turns on the power switch to start the controller 80, as in the first embodiment.

The display control section 814 displays the design selecting menu on the display unit 26.

The user operates, for example, the operational buttons 251 in the operational unit 25 to select a desired nail design from multiple nail designs appearing on the design selecting menu.

In response to this operation, selecting instruction signals are outputted from the operational unit 25 to select the nail design to be drawn on the nail T.

After the nail design is selected, the control unit 81 displays the instruction menu for prompting the pens 91 necessary for drawing the selected nail design to be mounted in the respective penholders 92 (i.e., indicating that the pens 91 containing which inks should be mounted in which penholders 92) on the display unit 26.

The control unit 81 may read the types of pens 91 set in the penholders 92 from, for example, bar codes. In this case, nail designs drawable with the pens 91 set in the penholders 92 may be displayed on the design selecting menu on the display unit 26 to prompt the user to select a nail design from the nail designs.

The user then inserts the print finger U1 into the finger receiving section 31 and the non-print fingers U2 into the finger evacuating section 32 and operates the switch on the operational unit 25 to start the drawing operation while the print finger U1 is fixed.

In order to replace the pens 91, the drawing control section 815 causes the head drive unit 47 to move the penholders 92 (the sub-carriage 45 to which the penholders 92 are fixed) to a position corresponding to the pen replacing cover 23.

The pen replacing cover 23 is then opened to detach the pens 91 manually. At this time, pulling the pen 91 manually can expand the fixers 921 of the penholder 92 in the horizontal direction to detach the pen 91 readily.

In order to attach the pen 91, pushing the pen 91 between the paired fixers 921 of the penholder 92 expands the fixers 921 in the horizontal direction to hold the pen from both sides between the fixers 921 on the penholder 92.

The other configurations are the same as those of the first embodiment to therefore omit redundant description.

Figure 15A:
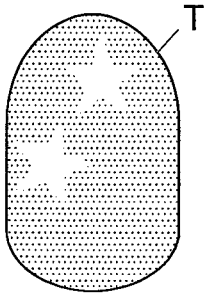
FIGS. 15A to 15C are plane views illustrating exemplary images drawn on nails with the drawing apparatus in the second embodiment.
Figure 15B:
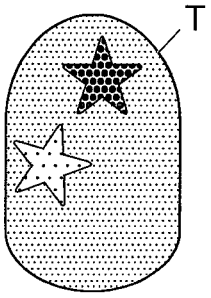
Figure 15C:
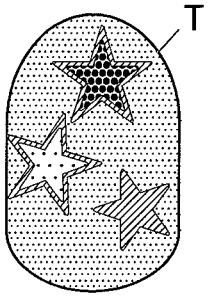

FIGS. 15A to 15C illustrate exemplary nail designs drawable on the nail T with the drawing apparatus in the present embodiment.

FIG. 15A illustrates undercoat for covering drawn with the pen 91 containing white ink on portions of a naked nail T or a nail T with a nail polish.

FIG. 15B illustrates an exemplary nail design obtained by drawing star patterns on the portions coated with the white ink in FIG. 15A with the ink jet drawing heads 46.

In this case, the regions, on which the star patterns are to be drawn with the ink jet drawing heads 46, are coated with the white ink and the pen 91.

The nail T of the print finger U1 is recognized and the white portions of the print finger U1 are then detected along with the recognition of the nail T.

Colored star patterns are then drawn with the ink jet drawing heads 46 to be aligned with the positions and the sizes of the white portions.

FIG. 15C illustrates an exemplary nail design obtained after the above procedure, for example, by recognizing the position of the star patterns drawn with the drawing heads 46 on the basis of an image taken again with the camera 51 and bordering the star patterns with the pen 91 containing golden glittering ink.

Clear topcoat is finally applied and dried to achieve durable nail print.

This procedure can draw an image of a gorgeous design obtained, for example, by depicting a glittering border to a full color pattern drawn on a naked nail T or a nail T with a desired nail polish.

When certain positional misalignment is caused during drawing of patterns with the drawing heads 46, such a border depicted with the pen 91 can hide such optional misalignment. In other words, the gap between or the peripheries of the patterns can eliminate coating or gradation of the undercoat or the nail T to be inconspicuous with the color.

As described above, the present embodiment can provide the following advantageous effects in addition to the same advantageous effects as those of the first embodiment.

The drawing apparatus in the present embodiment includes two penholders 92 that can hold the two pens 91 at the same time.

For example, in order to achieve the exemplary nail designs illustrated in FIGS. 15A to 15C, the penholder 92 holds the pen 91 for applying white undercoat ink and the pen 91 for drawing and bordering a pattern. This configuration can quickly perform processes from application of undercoat with the pen 91 to finishing of the nail print after drawing a full color image with the drawing heads 46 without replacing the pen.

The penholder 92 can hold the respective pens 91 containing two types, for example, of glittering inks to achieve a more gorgeous nail design and a variety of enjoyable nail prints.

The present invention can also be applicable to any embodiment other than the embodiments described above. Various modifications can be applied without departing from the scope and spirit of the present invention.

For example, although the second embodiment involves the coil spring 914 wound around the outer circumference of the pen body 913, the coil spring 914 may be eliminated.

Since the pen body 913 is also biased downward by its own weight, the pen body 913 having a sufficient weight can be urged by only the biasing force of its own weight against the surface of the nail T with force suitable for drawing an image, without the coil spring 914.

The first embodiment may further include a spring biasing the pen 48 downward to increase the drawing pressure.

The second embodiment exemplifies the inner cylinder 912 having the shaft receiving recess 912*a* receiving the lower end of the plunger 942 having a hemispherical or conical shape. Alternatively, the tip of the plunger 942 and the pen 91 receiving this tip may have any other shape.

For example, the pen 91 may include a shaft having a tip having a hemispherical or conical shape while the plunger 942 may have a recess receiving the tip at its lower end.

The second embodiment exemplifies the two pens 91 that can be mounted at the same time. Alternatively, additional penholders 92 may be provided for holding three or more pens 91.

A mechanism may also be provided for automatically replacing the pen 91 mounted in the penholder 92.

In this case, multiple pens are held in a standby space to automatically select a pen from the pens to be mounted in the penholder 92. Such a configuration can also increase the number of pens that can be held on the apparatus.

In the stated embodiments, the penholder or penholders are fixed on the sub-carriage 45 to drive the drawing heads 46 and the pens 91 while maintaining a constant distance therebetween. Any other configuration, however, may be applicable to driving the drawing heads 46 and the pens 91 while maintaining a constant distance therebetween. Alternatively, the pen may be mounted on the sub-carriage 45 together with the drawing heads 46 without a penholder.

Instead of fixing the pen or the penholder holding the pen to the drawing heads 46 or the carriage for the head, the drawing heads 46 and the pen may be driven in synchronization with each other to maintain a constant distance therebetween.

It is not essential that the drawing heads 46 and the pen are simultaneously driven by a head drive unit 47 and thus may be driven at different timings.

The drawing heads 46 and the pen may individually be driven at appropriate positions depending on a design image to be drawn, instead of a constant distance therebetween.

The stated embodiments each exemplify the solenoid serving as the pen up-and-down mechanism vertically moving the pen. The pen up-and-down mechanism, however, may have any other configuration. For example, step motors, DC motors, and motors and ball screws are also applicable.

The stated embodiments each exemplify the pen containing ink for drawing an image. Instead, the pen held on the penholder may contain any material other than ink for drawing.

For example, the pen may contain a colorless or colored transparent liquid paste. Such a pen mounted on the penholder may be used to apply the liquid paste onto the nail, and before the liquid paste is dry, for example, glittering powder or rhinestone may be placed thereon to achieve a more gorgeous nail design.

Alternatively, the pen may contain liquid including perfume. Such a pen mounted on the penholder may be used to apply the liquid including perfume to achieve scented enjoyable nail print.

The stated embodiments each exemplify a roll of paper (drawing medium 66) used for preconditioning the pen. The drawing medium 66, however, may be of any material, which is drawable with the pen, other than paper.

The drawing medium 66 may be of any type, such as sheets of paper, other than a roll of a medium. In this case, a medium inserting/ejecting opening is provided for inserting and ejecting sheets of paper.

The stated embodiments each exemplify the drawing data generating section 813 correcting a curved surface to be fit to the image data of a nail design and generating drawing data. The drawing data generating section 813 does not necessarily have to generate drawing data in the present invention. For example, instead of generation of drawing data, the drawing control section 815 may control the printing operation so as to appropriately convert the image data of a nail design with reference to, for example, a lookup table (LUT) and output the converted data to the drawing head or the pen to draw an image fit to the nail shape.

The stated embodiments each exemplify the detection of the nail information, such as the shape of the nail T and the generation of the drawing data based on this information. The nail information does not necessarily have to be detected in the present invention. If the extraction of the outline of the nail T is not essential for drawing an image (for example, if a pattern, e.g. a small design in one spot, is drawn in the middle of the nail T), the image can be drawn without correct recognition of, for example, the shape of the nail T and without detection of the nail information, such as the shape of the nail T.

The imaging device may be of any type, such as a video camera, other than the camera 51 taking still images. In this case, the camera takes a moving image to appropriately extract the image of the nail T from the taken moving image to be used for detection of the nail information.

The stated embodiments each exemplify the nail image storing area 821, the nail information storing area 822, and the nail design storing area 823, which are provided in the storing unit 82 of the controller 80. The nail image storing area 821, the nail information storing area 822, and the nail design storing area 823 may be provided in any component, such as another storing unit, other than the storing unit 82 of the controller 80.

The stated embodiments each exemplify the drawing apparatus 1 drawing an image on one finger inserted into the apparatus at a time. Alternatively, the present invention may be applied to an apparatus that can continuously draw images on, for example, four fingers.

For example, the movable range of the pen is extended to achieve a wider drawable range. This configuration can continuously draw images on multiple print fingers U1 inserted simultaneously.

The scope of the present invention should not be limited to the embodiments described herein and include the scope of the accompanying claims and equivalents thereof.

What is claimed is:

1. A drawing apparatus comprising:

a drawing unit which is provided with at least one drawing head which ejects a first ink to perform drawing on a drawing target and at least one drawing tool that has a tip portion that is adapted to contact with the drawing target to perform drawing with the tip portion on a portion of the drawing target contacting the tip portion by using a second ink; and a control unit which controls the drawing unit to perform a first drawing on the drawing target with one of the drawing head and the drawing tool and perform a second drawing with the other of the drawing head and the drawing tool over a region of the first drawing on the drawing target.

2. The drawing apparatus according to claim 1, further comprising an imaging unit which takes an image of the drawing target, wherein the imaging unit takes a first image of the drawing target on which the first drawing is performed; and wherein the control unit acquires a drawing region in which the first drawing is performed on the drawing target based on the first image and controls the drawing unit to perform the second drawing on the drawing region with the other of the drawing head and the drawing tool.

3. The drawing apparatus according to claim 2, wherein:

the drawing target is a surface of a nail of a finger or a toe, the surface having a curved shape in a width direction;

the imaging unit takes a second image of the drawing target on which drawing is not performed;

the drawing apparatus further comprises a nail information detecting section which detects at least one of a shape, a position, and a curvature of the curved shape of the nail of the finger or the toe as nail information based on the second image; and the control unit controls the drawing unit based on the nail information detected by the nail information detecting section.

4. The drawing apparatus according to claim 1, wherein:

the drawing unit comprises a drawing tool holder holding the drawing tool and a carriage supporting the drawing head; and the drawing tool holder is attached to the drawing head or the carriage.

5. The drawing apparatus according to claim 4, further comprising a head drive unit which moves the drawing head and the drawing tool, wherein the drive unit moves the drawing head and the drawing tool simultaneously to perform drawing.

6. The drawing apparatus according to claim 1, wherein the drawing head is an ink jet head which ejects the first ink; and wherein the second ink for the drawing tool is different from the first ink and has a particle diameter or viscosity inapplicable to the drawing head.

7. The drawing apparatus according to claim 6, wherein the control unit controls the drawing tool to perform the first drawing with the second ink and controls the drawing head to perform the second drawing with the first ink; and wherein the second ink is of a type capable of covering a color of the drawing target and serving as an undercoat for the first ink.

8. The drawing apparatus according to claim 6, wherein the second ink includes one selected from an ink containing a color material having the particle diameter inapplicable to the drawing head, a glittering ink, a UV-curable ink, a nailing gel, a nail polish for an undercoat, and a nail polish for a topcoat.

9. A control method for a drawing apparatus, comprising:

performing a first drawing on a drawing target with one of: (i) at least one drawing head which ejects a first ink to perform drawing on the drawing target, and (ii) at least one drawing tool which has a tip portion that is adapted to contact with the drawing target to perform drawing with the tip portion on a portion of the drawing target contacting the tip portion by using a second ink; and performing a second drawing with the other of the at least one drawing head and the at least one drawing tool over a region of the first drawing on the drawing target.

10. The control method for the drawing apparatus according to claim 9, wherein the drawing apparatus further comprises an imaging unit, the control method further comprising:

causing the imaging unit to take a first image of the drawing target on which the first drawing is performed;

acquiring a drawing region in which the first drawing is performed on the drawing target based on the first image; and performing the second drawing on the drawing region with the other of the drawing head and the drawing tool.

11. The control method for the drawing apparatus according to claim 10, wherein the drawing target is a surface of a nail of a finger or a toe, the surface having a curved shape in a width direction, the control method further comprising:

causing the imaging unit to take a second image of the drawing target on which drawing is not performed;

detecting at least one of a shape, a position, and a curvature of the curved shape of the nail of the finger or the toe as nail information based on the second image; and controlling the drawing head and the drawing tool based on the detected nail information.

12. The control method for the drawing apparatus according to claim 9, further comprising simultaneously moving the drawing head and the drawing tool to perform drawing.

13. The control method for the drawing apparatus according to claim 9, wherein the drawing head is an ink jet head which ejects the first ink, and the second ink for the drawing tool is different from the first ink and has a particle diameter or viscosity inapplicable to the drawing head, the control method further comprising:

performing the first drawing with the drawing tool on the drawing target with the second ink capable of covering a color of the drawing target and serving as an undercoat for the first ink; and performing the second drawing with the first ink with the drawing head.

14. A drawing apparatus comprising:

a drawing unit which is provided with at least one drawing head which ejects a first ink to perform drawing on a drawing target and at least one drawing tool that is adapted to contact with the drawing target to perform drawing on a portion of the drawing target contacting the drawing tool by using a second ink;

an imaging unit which takes an image of the drawing target on which a first drawing is performed with one of the drawing head and the drawing tool; and a control unit which acquires a drawing region in which the first drawing is performed on the drawing target based on the image and which controls the drawing unit to perform a second drawing with the other of the drawing head and the drawing tool over the drawing region of the drawing target.

15. The drawing apparatus according to claim 14, wherein the drawing target is a surface of a nail of a finger or a toe, the surface having a curved shape in a width direction.

16. The drawing apparatus according to claim 14, wherein the drawing unit comprises a drawing tool holder holding the drawing tool and a carriage supporting the drawing head; and wherein the drawing tool holder is attached to the drawing head or the carriage.

17. The drawing apparatus according to claim 16, further comprising a head drive unit which moves the drawing head and the drawing tool, wherein the drive unit moves the drawing head and the drawing tool simultaneously to perform the drawing.

18. The drawing apparatus according to claim 14, wherein:

the drawing head is an ink jet head which ejects the first ink, the drawing tool is a pen having a pen tip that is adapted to contact with the drawing target, and the second ink is different from the first ink and has a particle diameter or viscosity inapplicable to the drawing head.

19. The drawing apparatus according to claim 18, wherein the control unit controls the drawing tool to perform the first drawing with the second ink and controls the drawing head to perform the second drawing with the first ink; and wherein the second ink is of a type capable of covering a color of the drawing target and serving as an undercoat for the first ink.

20. The drawing apparatus according to claim 18, wherein the second ink includes one selected from an ink containing a color material having the particle diameter inapplicable to the drawing head, a glittering ink, a UV-curable ink, a nailing gel, a nail polish for an undercoat, and a nail polish for a topcoat.

* * * * *